US008899259B2

(12) United States Patent
Jonte et al.

(10) Patent No.: US 8,899,259 B2
(45) Date of Patent: Dec. 2, 2014

(54) FAUCET MOUNTING ANCHOR

(75) Inventors: Patrick B. Jonte, Zionsville, IN (US); Michael Scot Rosko, Greenwood, IN (US); Todd Midkiff, Noblesville, IN (US); Michael J. Veros, Carmel, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 212 days.

(21) Appl. No.: 13/695,322

(22) PCT Filed: May 23, 2011

(86) PCT No.: PCT/US2011/037610

§ 371 (c)(1),
(2), (4) Date: Oct. 30, 2012

(87) PCT Pub. No.: WO2011/146939

PCT Pub. Date: Nov. 24, 2011

(65) Prior Publication Data

US 2013/0048100 A1 Feb. 28, 2013

Related U.S. Application Data

(60) Provisional application No. 61/347,270, filed on May 21, 2010.

(51) Int. Cl.
*F16K 5/00* (2006.01)
*E03C 1/04* (2006.01)

(52) U.S. Cl.
CPC ..... *E03C 1/0402* (2013.01); *E03C 2001/0416* (2013.01)
USPC ..... 137/315.12; 137/359; 137/801; 4/678; 285/193

(58) Field of Classification Search
CPC ..... E03C 1/0401; E03C 2001/0416
USPC ..... 137/215.12, 801, 359; 4/675–678; 285/193
See application file for complete search history.

(56) References Cited

U.S. PATENT DOCUMENTS 1,592,353 A 7/1926 Gade
2,173,064 A 9/1939 Judell (Continued)

FOREIGN PATENT DOCUMENTS

CH 275914 6/1951
CN 1278584 1/2001

(Continued)

OTHER PUBLICATIONS

International Search Report and Written Opinion dated Sep. 29, 2011, PCT International Application No. PCT/US11/37610, 8 pages.

(Continued)

*Primary Examiner* — John K Fristoe, Jr.
*Assistant Examiner* — Kevin Barss
(74) *Attorney, Agent, or Firm* — Faegre Baker Daniels LLP

(57) ABSTRACT

A faucet assembly may include a body housing and an anchor. The anchor may be positioned within a mounting deck, and the body housing may include a mounting tube. The mounting tube may include fingers that releasably engage with one or more structures of the anchor. A screw positioned within the body housing may engage the mounting tube, and draw the mounting tube into the body housing. The fingers of the mounting tube may engage with a structure of the anchor and may close around the structure as the mounting tube is drawn into the body housing.

16 Claims, 21 Drawing Sheets

(56) References Cited

U.S. PATENT DOCUMENTS 2,591,991 A 4/1952 Young
2,848,721 A 8/1956 Fredrickson
3,010,474 A 11/1961 Moen
3,012,251 A 12/1961 Fife
3,035,276 A 5/1962 Hanson
3,155,115 A 11/1964 Ziegler
3,229,710 A 1/1966 Keller, III
3,427,049 A 2/1969 Politz
3,448,768 A 6/1969 Keller, III
3,495,616 A 2/1970 Esposito
3,561,485 A 2/1971 Klingler
3,600,723 A 8/1971 Mongerson et al.
3,609,774 A 10/1971 Allgood
3,645,493 A 2/1972 Manoogian et al.
3,790,966 A 2/1974 Keane
3,796,380 A 3/1974 Johnson et al.
3,807,453 A 4/1974 Dom et al.
3,911,946 A 10/1975 Humpert et al.
3,998,240 A 12/1976 Liautaud
4,026,328 A 5/1977 Nelson
4,064,900 A 12/1977 Schmitt
4,186,761 A 2/1980 Guarnieri
RE30,559 E 3/1981 Schmitt
4,290,445 A 9/1981 Turner
4,328,830 A 5/1982 Greer
4,337,795 A 7/1982 Argyris et al.
4,356,574 A 11/1982 Johnson
4,387,738 A 6/1983 Bisonaya et al.
4,446,885 A 5/1984 Nolden
4,458,839 A 7/1984 MacDonald
4,513,769 A 4/1985 Purcell
4,552,171 A 11/1985 Farrell et al.
4,635,673 A 1/1987 Gerdes
4,649,958 A 3/1987 Purcell
4,660,803 A 4/1987 Johnston et al.
4,671,316 A 6/1987 Botnick
4,678,002 A 7/1987 Valley
4,700,928 A 10/1987 Marty
4,706,702 A 11/1987 Grasseschi
4,760,861 A 8/1988 Botnick
4,762,143 A 8/1988 Botnick
4,762,273 A 8/1988 Gregory et al.
4,771,485 A 9/1988 Traylor
4,827,538 A 5/1989 Heimann et al.
4,848,395 A 7/1989 Krippendorf
4,852,192 A 8/1989 Viegener
4,856,121 A 8/1989 Traylor
4,903,725 A 2/1990 Ko
4,911,335 A 3/1990 Stofle et al.
4,966,186 A 10/1990 Rodstein
4,998,555 A 3/1991 Barhydt, Sr. et al.
5,010,922 A 4/1991 Agresta
5,020,569 A 6/1991 Agresta
5,027,851 A 7/1991 Drees et al.
5,073,991 A 12/1991 Marty
5,090,062 A 2/1992 Hochstrasser
5,095,554 A 3/1992 Gloor
5,127,427 A 7/1992 Kajpust et al.
5,127,438 A 7/1992 Williams
5,131,428 A 7/1992 Bory
5,148,832 A 9/1992 Lin
5,165,121 A 11/1992 McTargett et al.
5,232,008 A 8/1993 Jeffress et al.
5,275,199 A 1/1994 Howell
5,349,987 A 9/1994 Shieh
5,361,431 A 11/1994 Freier et al.
5,375,272 A 12/1994 Mikol
5,388,287 A 2/1995 Tischler et al.
5,458,154 A * 10/1995 Niemann et al. ..... 137/801
5,465,749 A 11/1995 Sauter et al.
5,467,799 A 11/1995 Buccicone et al.
5,515,882 A 5/1996 Hennis
5,518,016 A 5/1996 Sharwark
5,535,776 A 7/1996 Kingman
5,558,128 A 9/1996 Pawelzik et al.
5,566,707 A 10/1996 Ching et al.
5,642,755 A 7/1997 Mark et al.
5,660,203 A 8/1997 Gnauert et al.
5,669,407 A 9/1997 Bailey
5,669,417 A 9/1997 Lian-Jie
5,685,341 A 11/1997 Chrysler et al.
5,687,952 A 11/1997 Arnold et al.
5,725,008 A 3/1998 Johnson
5,746,244 A 5/1998 Woolley, Sr. et al.
5,758,688 A 6/1998 Hamanaka et al.
5,797,151 A 8/1998 Ko
5,803,120 A 9/1998 Bertoli
5,813,431 A 9/1998 Cool et al.
5,822,811 A 10/1998 Ko
5,845,345 A 12/1998 Ko
5,865,211 A 2/1999 Thomas
5,865,473 A 2/1999 Semchuck et al.
5,884,662 A 3/1999 Ko
5,894,613 A 4/1999 Fenn
5,918,855 A 7/1999 Hamanaka et al.
5,924,451 A 7/1999 Kuo
5,946,746 A 9/1999 Bloom
5,950,663 A 9/1999 Bloomfield
5,960,490 A 10/1999 Pitsch
5,979,489 A 11/1999 Pitsch
5,983,917 A 11/1999 Thomas
6,006,784 A 12/1999 Tsutsui et al.
6,014,985 A 1/2000 Warshawsky
6,023,796 A 2/2000 Pitsch
6,062,251 A 5/2000 Pitsch
6,073,972 A 6/2000 Rivera
6,082,407 A 7/2000 Paterson et al.
6,085,784 A 7/2000 Bloom et al.
6,123,106 A 9/2000 Benstead
6,125,875 A 10/2000 Dempsey et al.
6,138,296 A 10/2000 Baker
6,161,230 A 12/2000 Pitsch
6,170,098 B1 1/2001 Pitsch
6,189,569 B1 2/2001 Calhoun
6,195,818 B1 3/2001 Rodstein et al.
6,202,686 B1 3/2001 Pitsch et al.
6,202,980 B1 3/2001 Vincent et al.
6,209,153 B1 4/2001 Segien, Jr.
6,220,278 B1 4/2001 Sauter et al.
6,220,279 B1 4/2001 Segien
6,256,810 B1 7/2001 Baker
6,267,136 B1 7/2001 Johnson
6,273,138 B1 8/2001 Yoney
6,273,394 B1 8/2001 Vincent et al.
6,301,728 B1 10/2001 Pilatowicz et al.
6,302,131 B1 10/2001 Pitsch
6,314,593 B1 11/2001 Mantel
6,328,059 B1 12/2001 Testori et al.
6,334,226 B1 1/2002 Tokunaga et al.
6,360,770 B1 3/2002 Buchner et al.
6,360,774 B1 3/2002 Becker et al.
6,370,712 B1 4/2002 Burns et al.
6,378,912 B1 4/2002 Condon et al.
6,385,798 B1 5/2002 Burns et al.
6,405,749 B1 6/2002 Bloom et al.
6,421,849 B1 7/2002 Gray
6,422,520 B1 7/2002 Hand
6,434,765 B1 8/2002 Burns et al.
6,438,771 B1 8/2002 Donath, Jr. et al.
6,457,191 B2 10/2002 Brandebusemeyer et al.
6,484,330 B2 11/2002 Gray et al.
6,491,058 B1 12/2002 Wang
6,571,407 B1 6/2003 Skarie
6,619,320 B2 9/2003 Parsons
6,631,730 B1 10/2003 Bloom et al.
6,672,628 B2 1/2004 Thomas et al.
6,684,906 B2 2/2004 Burns et al.
6,718,568 B1 4/2004 Hensley
6,725,472 B2 4/2004 Gray et al.
6,757,921 B2 7/2004 Esche
6,792,629 B2 9/2004 Nelson et al.
6,807,692 B2 10/2004 Tsutsui et al.
6,868,564 B2 3/2005 Ginter et al.
6,874,527 B2 4/2005 Meeder

(56) References Cited

U.S. PATENT DOCUMENTS

| | | | |
|---|---|---|---|
| 6,874,535 | B2 | 4/2005 | Parsons et al. |
| 6,912,742 | B1 | 7/2005 | Wang |
| 6,918,400 | B2 | 7/2005 | Buchner et al. |
| 7,017,600 | B2 | 3/2006 | Klein |
| 7,055,545 | B2 | 6/2006 | Mascari et al. |
| 7,174,581 | B2 | 2/2007 | McNerney et al. |
| 7,175,158 | B2 | 2/2007 | Thomas |
| 7,269,864 | B2 | 9/2007 | Brown et al. |
| 7,406,980 | B2 | 8/2008 | Pinette |
| 7,698,755 | B2 | 4/2010 | McNerney et al. |
| 7,766,043 | B2 | 8/2010 | Thomas et al. |
| 7,979,929 | B2 | 7/2011 | Vogel et al. |
| 2001/0011389 | A1 | 8/2001 | Philipps-Liebich et al. |
| 2001/0044955 | A1 | 11/2001 | Brandebusemeyer |
| 2002/0083520 | A1 | 7/2002 | Osborne-Kirby |
| 2002/0124309 | A1 | 9/2002 | Donath, Jr. et al. |
| 2002/0185182 | A1 | 12/2002 | Wang |
| 2002/0189674 | A1 | 12/2002 | Meeder |
| 2003/0204906 | A1 | 11/2003 | Tsutsui et al. |
| 2003/0221254 | A1 | 12/2003 | McNerney et al. |
| 2004/0034924 | A1 | 2/2004 | Underbrink et al. |
| 2004/0060109 | A1 | 4/2004 | Hensley |
| 2004/0094202 | A1 | 5/2004 | Kawolics et al. |
| 2004/0123910 | A1 | 7/2004 | Yardley |
| 2004/0143900 | A1 | 7/2004 | Nelson et al. |
| 2004/0154673 | A1 | 8/2004 | Mascari et al. |
| 2004/0179351 | A1 | 9/2004 | Patterson |
| 2004/0200987 | A1 | 10/2004 | Houghton |
| 2004/0221899 | A1 | 11/2004 | Parsons et al. |
| 2005/0022299 | A1 | 2/2005 | Brown et al. |
| 2005/0199843 | A1 | 9/2005 | Jost et al. |
| 2005/0242198 | A1 | 11/2005 | Kempf et al. |
| 2005/0242199 | A1 | 11/2005 | Kempf et al. |
| 2005/0251907 | A1 | 11/2005 | Mintz et al. |
| 2006/0042006 | A1 | 3/2006 | Thomas |
| 2006/0076056 | A1 | 4/2006 | Schmitt et al. |
| 2007/0044232 | A1 | 3/2007 | McNerney et al. |
| 2007/0271695 | A1 | 11/2007 | Thomas et al. |
| 2009/0255588 | A1 | 10/2009 | Bors et al. |
| 2011/0094604 | A1 | 4/2011 | Thomas et al. |
| 2013/0048100 | A1 | 2/2013 | Jonte et al. |

FOREIGN PATENT DOCUMENTS

| | | | |
|---|---|---|---|
| CN | 1278585 | | 1/2001 |
| CN | 1278586 | | 1/2001 |
| CN | 1278588 | | 1/2001 |
| DE | 100 22 350 | A1 | 11/2001 |
| EP | 0 808 952 | B1 | 9/2003 |
| EP | 2112281 | | 10/2009 |
| GB | 371616 | | 5/1931 |
| JP | 2006/328812 | | 12/2006 |
| WO | WO 2005/056937 | | 6/2005 |
| WO | WO 2005/118966 | | 12/2005 |
| WO | WO 2007/027340 | | 3/2007 |
| WO | WO 2009/155529 | | 12/2009 |
| WO | WO 2011/146939 | | 11/2011 |

OTHER PUBLICATIONS

International Preliminary Report on Patentability dated Jun. 28, 2012, PCT International Application No. PCT/US11/37610, 12 pages.

* cited by examiner

FAUCET MOUNTING ANCHOR

CROSS-REFERENCE TO RELATED APPLICATION

This application is a 371 national phase filing of International Application No. PCT/US2011/037610, filed May 23, 2011, which claims the benefit of U.S. Provisional Application Ser. No. 61/347,270, filed May 21, 2010, the disclosures of which are expressly incorporated by reference herein.

BACKGROUND AND SUMMARY

The present disclosure relates generally to faucets and, more particularly, to a mounting system for a faucet.

The installation of a faucet onto a mounting deck is often a difficult and time-consuming task. At least some of the installation may require the installer to work in the cramped and dimly lit work area under the sink or mounting deck. More particularly, faucets are typically attached to the mounting deck with threaded connections which must be made under and behind the sink basin wherein there is very little room to work.

As such, there is a need to provide a less cumbersome and complicated system of installing faucets or interchanging different faucet styles onto a mounting deck which can be done largely from the top of the countertop or sink.

According to an illustrative embodiment of the present disclosure, a faucet assembly may include an anchor including a mounting body extending between opposing upper and lower ends. The upper end of the mounting body may include a retaining lip, a faucet support positioned above the anchor, an adapter positioned within the faucet support, and a mounting tube positioned within the faucet support and operably coupled to the adapter, the mounting tube comprising at least one finger arranged about an opening having a diameter, the at least one finger releasably engaging the lip of the anchor if the diameter is reduced, wherein rotation of the adapter draws the mounting tube within the mounting body, moving the one or more fingers inward and reducing the diameter such that the at least one finger releasably engages the lip of the anchor thereby coupling the faucet support to the anchor.

According to another illustrative embodiment of the present disclosure, a faucet assembly may include a first anchor, including a body extending between opposing upper and lower ends, the first anchor including external threads disposed on the upper end of the body. The faucet assembly may also include a housing receiving a mixing valve, the housing including internal threads to engage with the external threads of the first anchor. The faucet assembly may also include a second anchor including a body having at least one recess. The faucet assembly may also include a spout assembly comprising a substantially hollow spout with opposing first and second openings, a connector tube releasably attached to the spout at the first opening of the spout, the connector tube including a groove, and a bearing releasably attached to the tube, the bearing including first fingers to engage with the groove of the connector tube and second fingers to engage with the one or more voids in the second anchor, wherein rotation of the spout rotates the mounting tube relative to the first fingers of the bearing, and the bearing remains fixed relative to the second anchor.

Additional features and advantages of the present disclosure will become apparent to those skilled in the art upon consideration of the following detailed description of the illustrative embodiment exemplifying the best mode of carrying out the disclosure as presently perceived.

BRIEF DESCRIPTION OF THE DRAWINGS

The detailed description of the drawings particularly refers to the accompanying figures in which.

Figure 1:
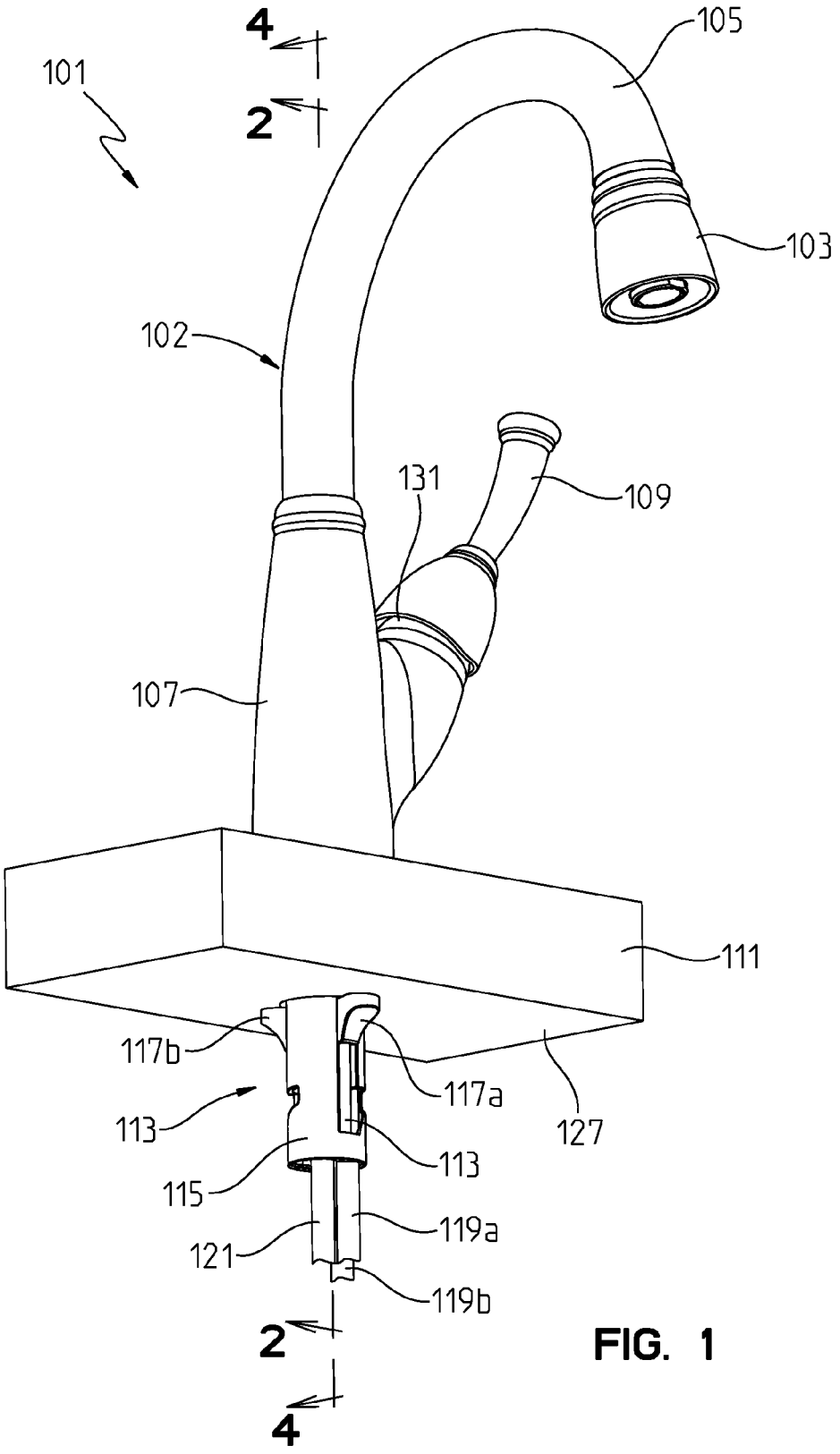
FIG. 1 is a bottom perspective view of a faucet assembly according to an embodiment of the present disclosure.

Corresponding reference characters indicate corresponding parts throughout the several views. Unless otherwise stated, the drawings are proportional. The exemplifications set out herein illustrate exemplary embodiments of the disclosure and such exemplifications are not to be construed as limiting the scope of the disclosure in any manner.

DETAILED DESCRIPTION OF THE DRAWINGS

The embodiments of the disclosure described herein are not intended to be exhaustive or to limit the disclosure to precise forms disclosed. Rather, the embodiment selected for description have been chosen to enable one skilled in the art to practice the disclosure.

Figure 7:
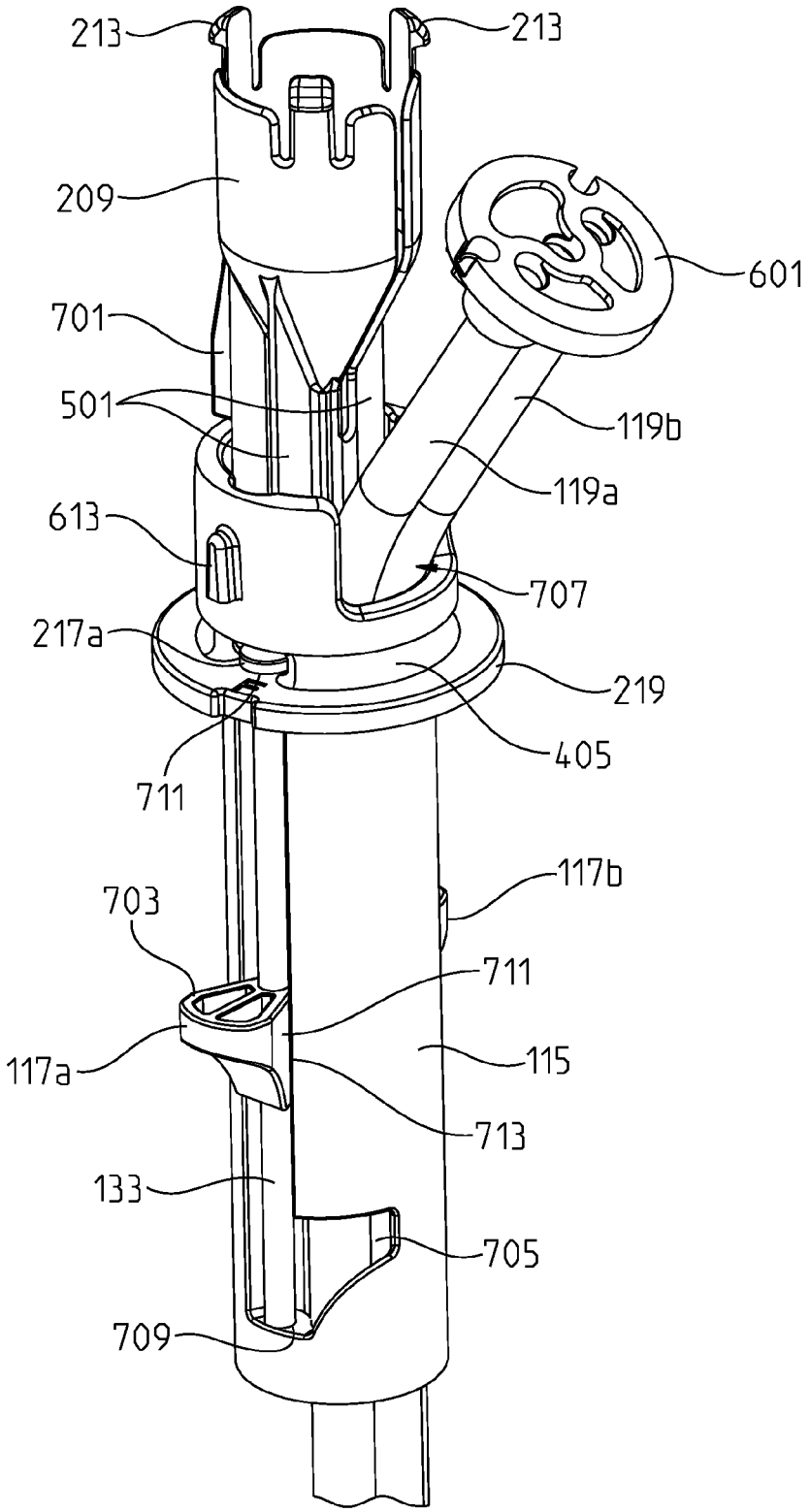
FIG. 7 is a side perspective view of a sleeve and anchor assembly according to an embodiment of the present disclosure.
Figure 8:
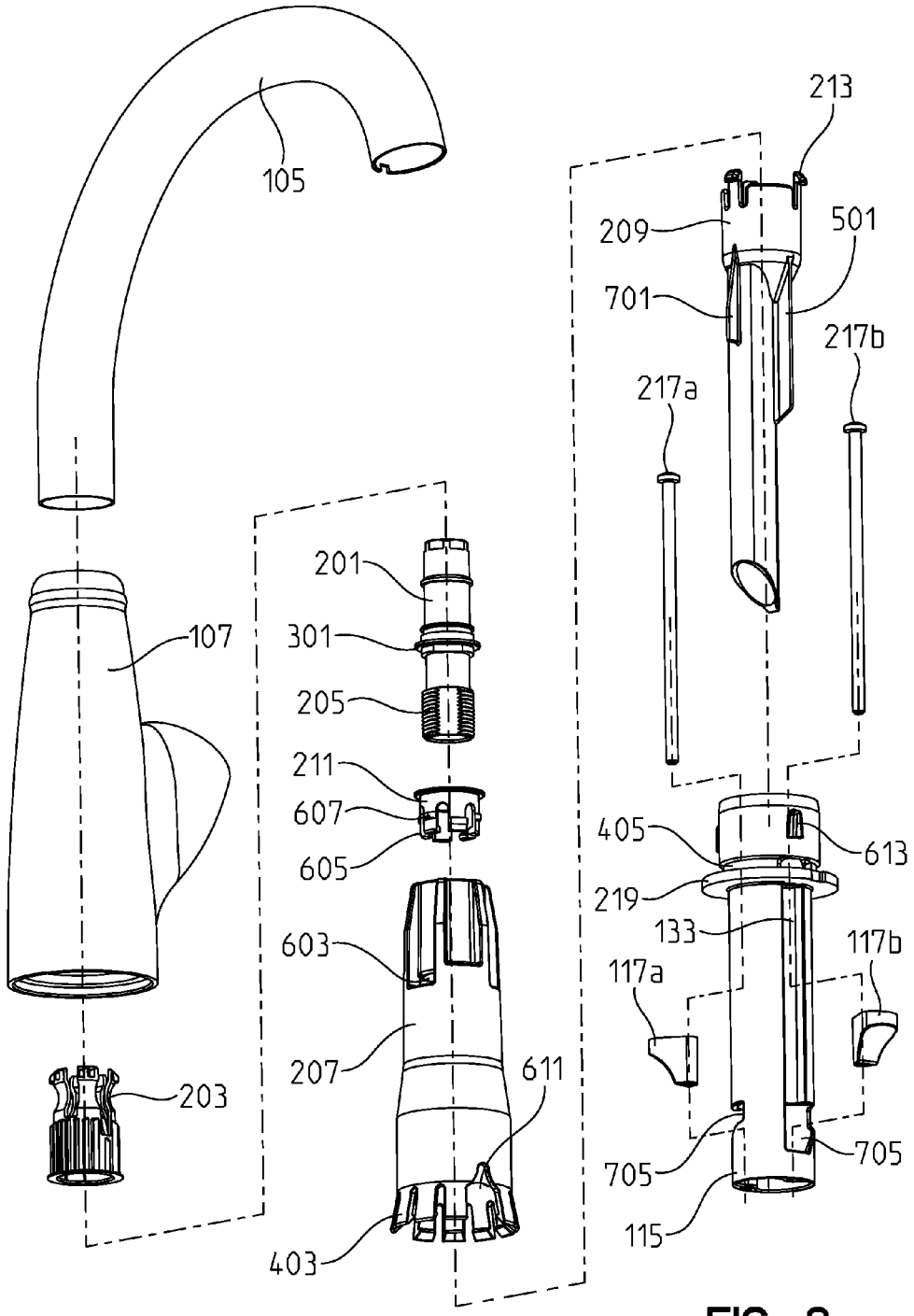
FIG. 8 is an exploded perspective view of a faucet assembly according to an embodiment of the present disclosure.
Figure 9:
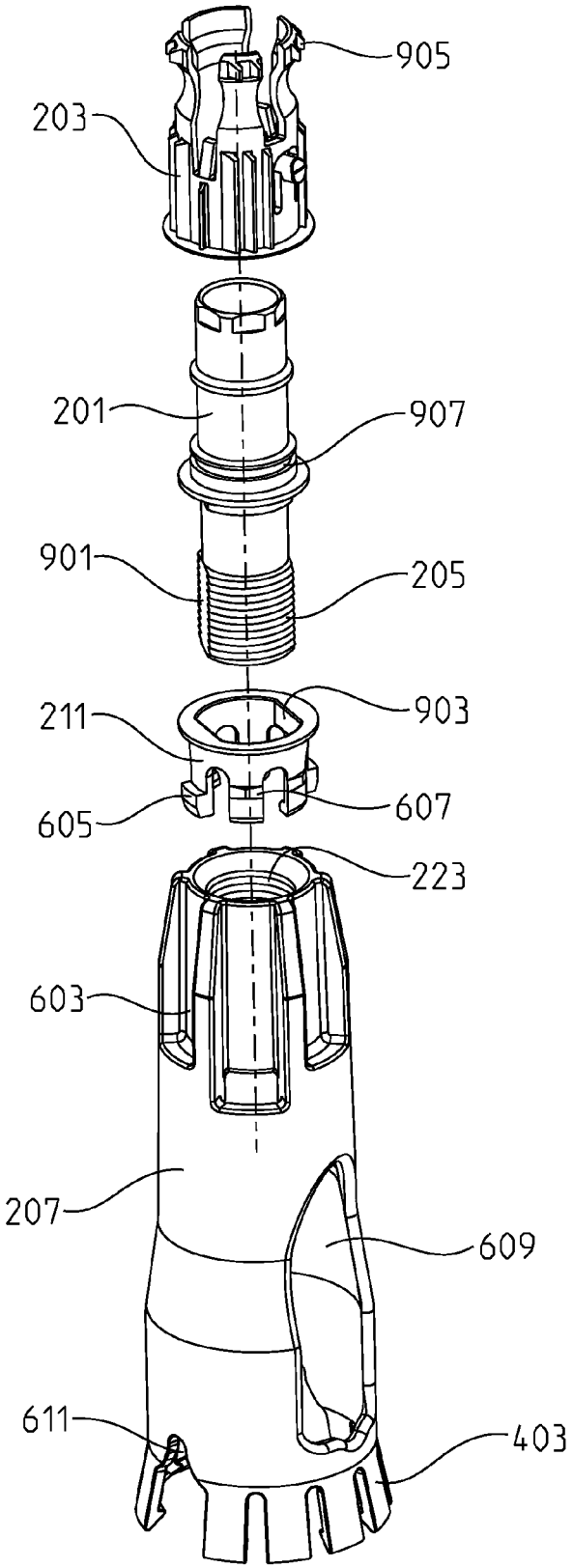
FIG. 9 is an exploded perspective view of a mounting tube and adapter according to an embodiment of the present disclosure.

Referring initially to FIGS. 1-10, and with particular reference to FIG. 9, a faucet assembly 101 is shown. An anchor 115 is mounted to a mounting deck 111. The mounting tube 207 is positioned within a faucet assembly 101 or faucet support, including the delivery spout 107, and the adapter 201 and the clutch 211 are installed in the mounting tube 207 inside the delivery spout 107. The sleeve 209 may optionally be installed in the mounting tube 207, and guides conduits through the mounting tube 207 and the anchor 115. In operation, the delivery spout 107 with the mounting tube 207 including the adapter 201 and the clutch 211 are positioned over the anchor 115, so that the fingers 403 of the mounting tube 207 are adjacent to the lip 405 of the anchor 115. The adapter 201 is rotated, drawing the mounting tube 207 into the delivery spout 107 and reducing the diameter of opening in the mounting tube containing the fingers 403. The fingers 403 engage with the lip 405 of the anchor 115, forcing the delivery spout 107 towards the mounting deck 111, so that the delivery spout 107 is in releasable communication with the anchor 115. The neck adapter 203 includes fingers that engage with the adapter 201 and the neck 105, so that rotation of the neck 105 does not rotate the adapter 201 (i.e., the neck 105 may freely rotate without rotating the other components of the faucet assembly 101).

The illustrative embodiment of a faucet assembly 101 is shown as including an upper faucet assembly 102 positioned above an anchor assembly 113. The upper faucet assembly 102 illustratively includes a body housing or delivery spout 107 including a mixing valve 407 coupled to a handle 109, and a neck 105 in communication with a pull-out spray head 103 (i.e., detachable from the neck 105 of the delivery spout 107). The mixing valve 407 is fluidly coupled to a waterway assembly 119*a*, 119*b*, and 121, which provides fluid communication to hot and cold water supplies (not shown). The waterway assembly 119*a*, 119*b*, and 121 also illustratively provides fluid communication between an outlet of the mixing valve 407 and the pull out spray head 103. An anchor 115 is secured to a lower portion of the delivery spout 107. The anchor assembly 113 includes an anchor body 115 which receives fasteners 403 to couple the anchor 115 to the delivery spout 107, shown in FIG. 4. The anchor 115 also includes cleats 117*a* and 117*b* to secure the anchor 115 to the lower surface 127 of the mounting deck 111. Described more fully below, the cleats 117*a* and 117*b* ride longitudinally in a track 133 disposed in the anchor 115. Inlet conduits (119*a* shown in FIG. 1, 119*b* shown, for example, in FIGS. 1 and 4) may supply, for example, water from hot and cold water sources (not shown) to the mixing valve 407. The mixing valve 407 may adjust the flow from the inlet conduits 119*a* and 119*b*, and the mixed sources may flow into an outlet conduit 121 fluidly coupled to the spray head 103.

With further reference to FIG. 1, a handle 109 is coupled to a stem 409 of the mixing valve 407 in a conventional manner, for example, through the use of a set screw (not shown). The mixing valve 407 controls the rate and relative proportion of water flowing from cold and hot water inlet conduits 119*a* and 119*b*, of the waterway assembly 20 to outlet conduit 121. The mixing valve 18 may be of conventional design, and illustratively of the type disclosed in U.S. patent application Ser. No. 11/494,889, filed Jul. 28, 2006, entitled "MIXING VALVE," incorporated by reference herein. Similarly, the waterway assembly may be of conventional design, and illustratively of the type disclosed in U.S. patent application Ser. No. 11/700,634, filed Jan. 31, 2007, entitled "FAUCET INCLUDING A MOLDED WATERWAY ASSEMBLY," incorporated by reference herein.

Each of the inlet conduits 119*a* and 119*b* illustratively includes an end connector (not shown) configured to couple to a fluid coupling for supplying water from hot and cold water sources (not shown). The fluid couplings may comprise a quick release coupling, such as PMC Series couplings available from Colder Products Company of St. Paul, Minn. Other conventional fluid couplings may be substituted therefor, such as those detailed in U.S. Pat. No. 6,672,628.

Illustratively, the inlet conduits 119*a* and 119*b* are formed of a flexible tubular material to facilitate positioning of the respective end connectors (not shown) relative to the faucet assembly 101. In one illustrative embodiment, the inlet conduits 119*a* and 119*b* and outlet conduit 121 are all formed of cross-linked polyethylene (PEX).

Figure 2:
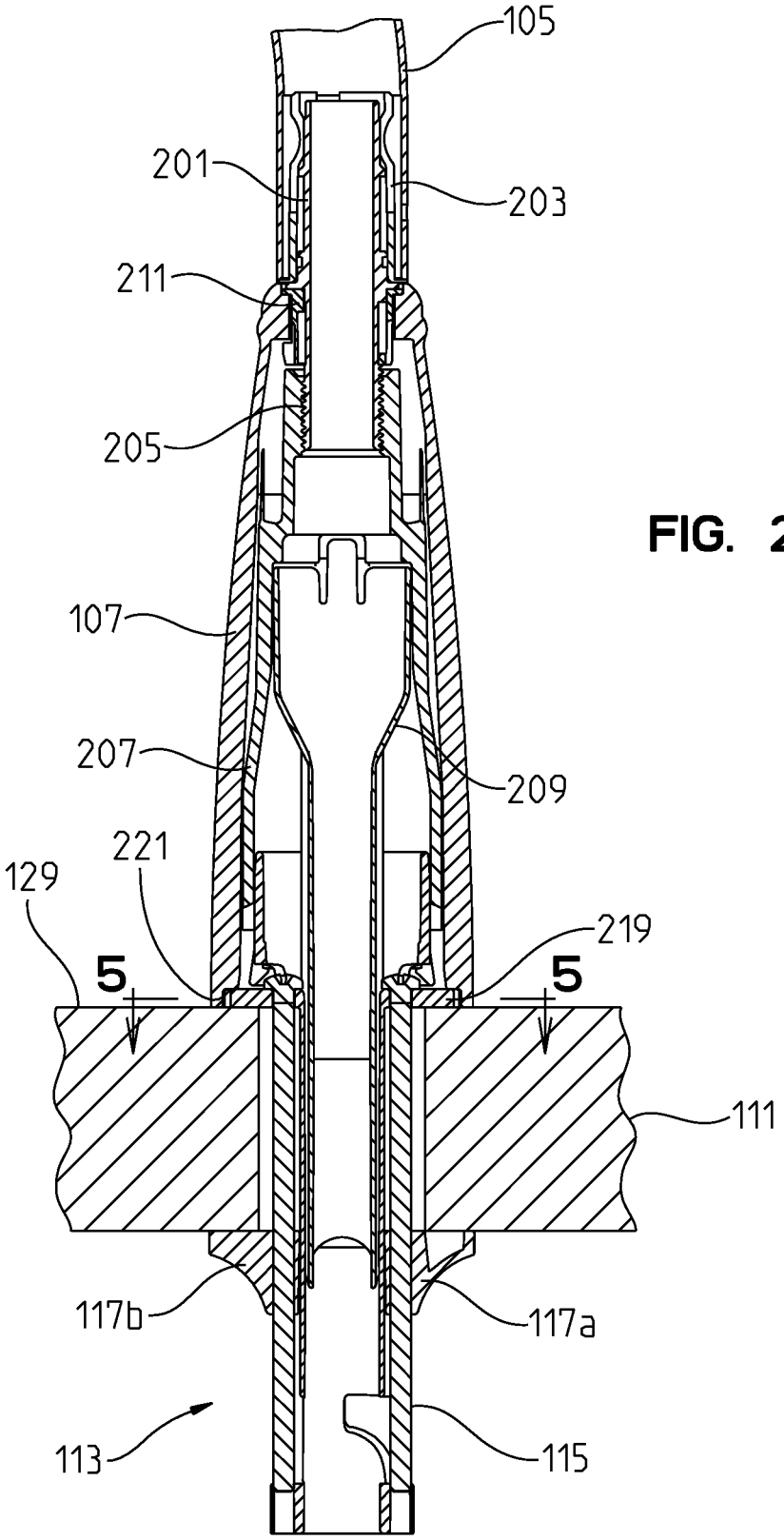
FIG. 2 is a cross-sectional view taken along line 2-2 of FIG. 1.
Figure 3:
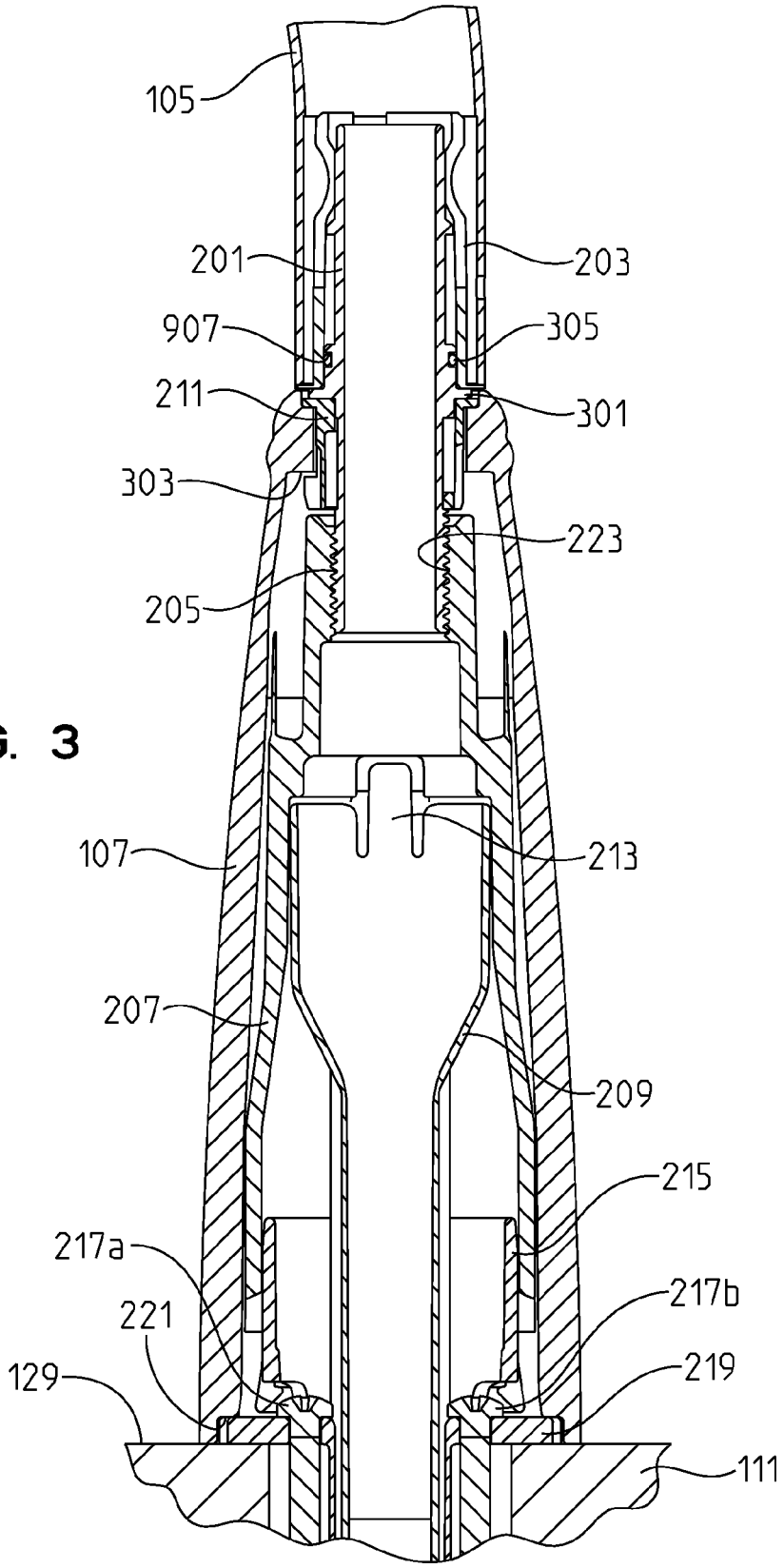
FIG. 3 is a detailed cross-sectional view of a portion of FIG. 2.
Figure 4:
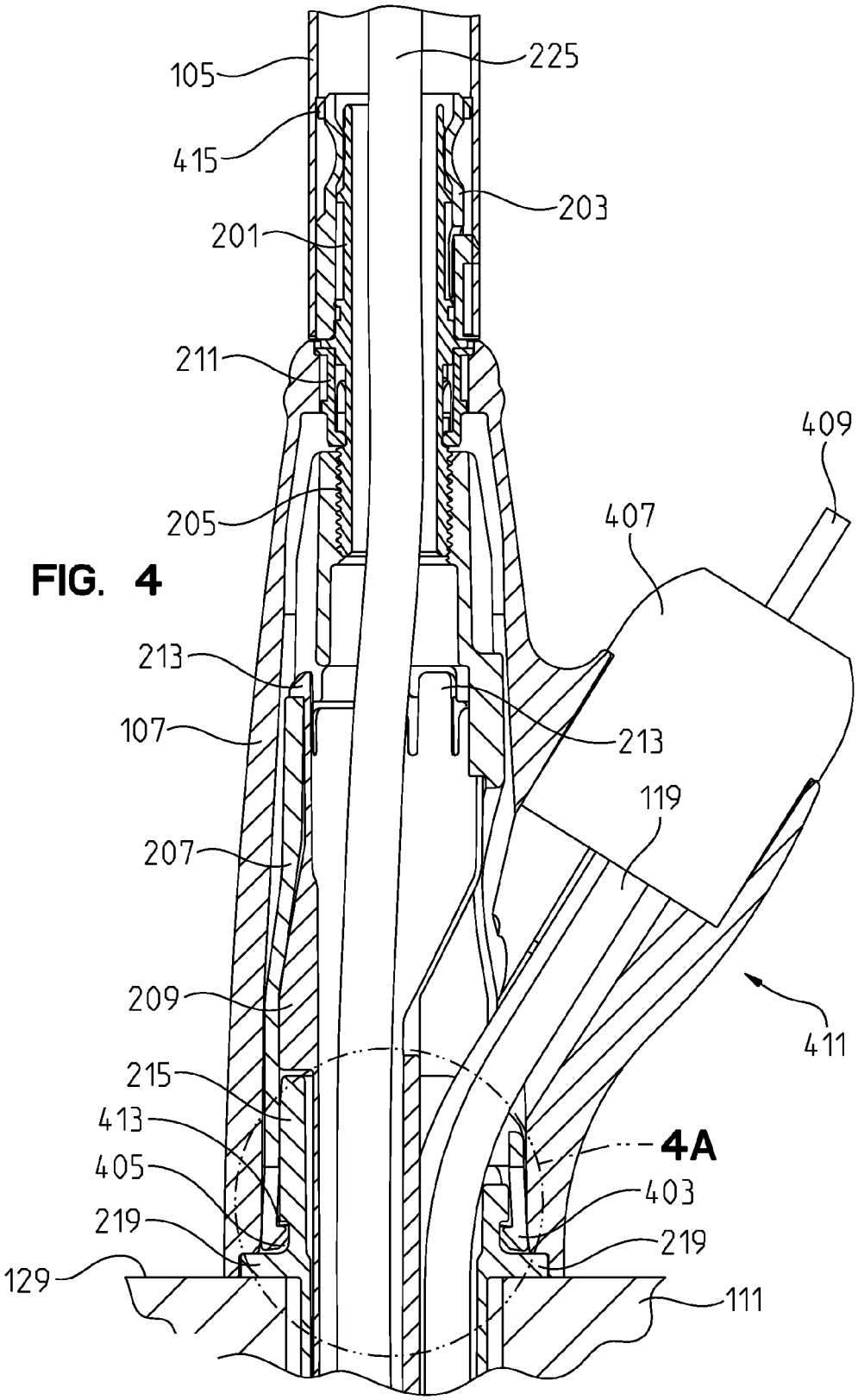
FIG. 4 is a cross-sectional view of the faucet assembly taken along line 4-4 of FIG. 1, with the handle removed to show the mixing valve.
Figure 4A:
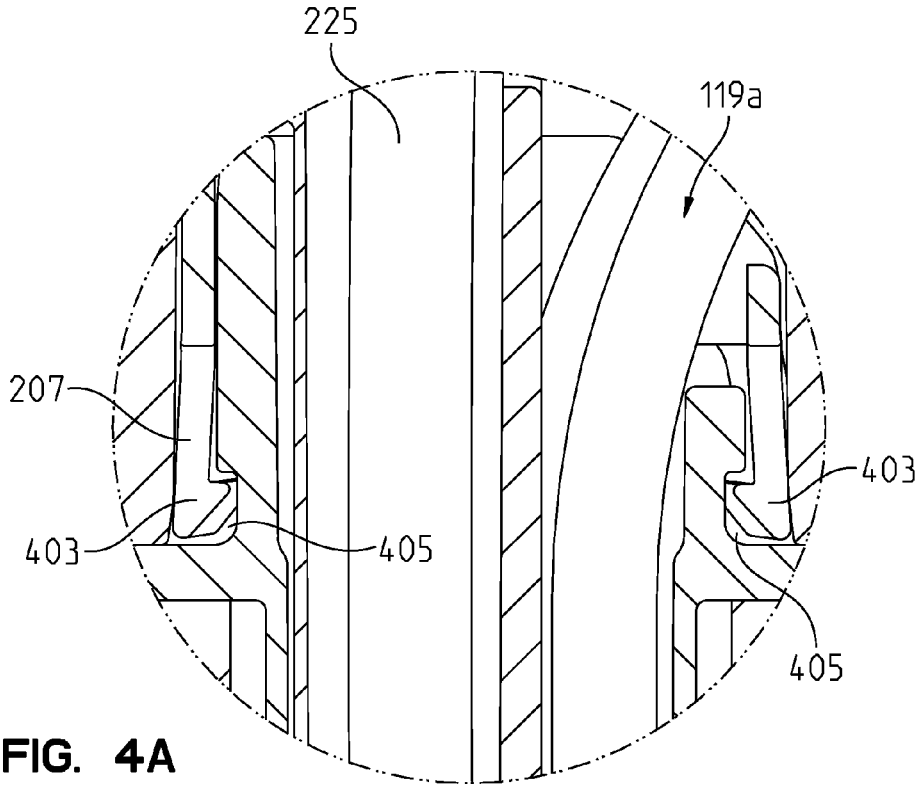
FIG. 4A is a detailed view of a portion of FIG. 4.
Figure 5:
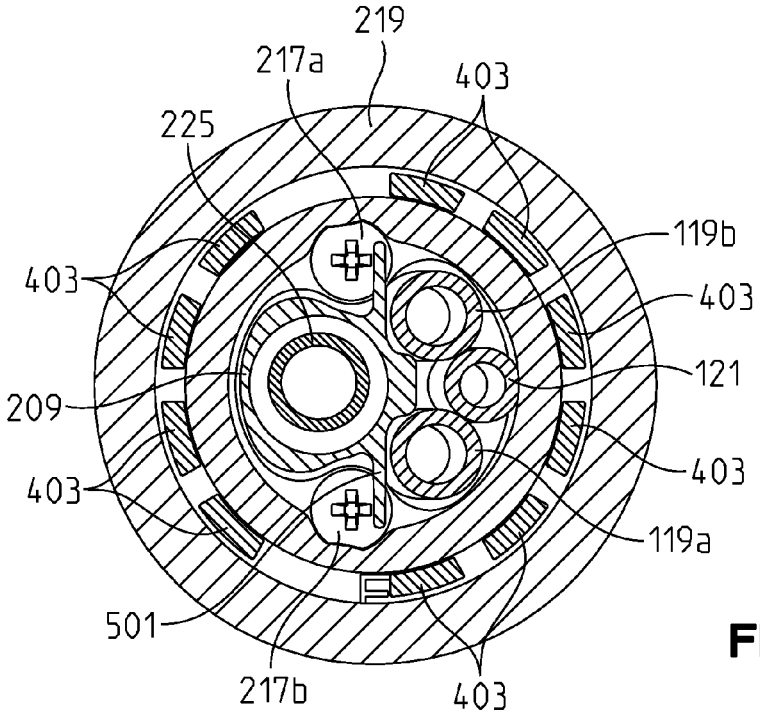
FIG. 5 is a cross-sectional view of the faucet assembly taken along line 5-5 of FIG. 2.

With reference to FIGS. 2 and 3, the anchor 115 is supported by a mounting deck 111, typically a countertop or sink deck having one or more access openings. As detailed herein, a coupler or guide releasably couples the upper faucet assembly 102 to the anchor 115.

Figure 10:
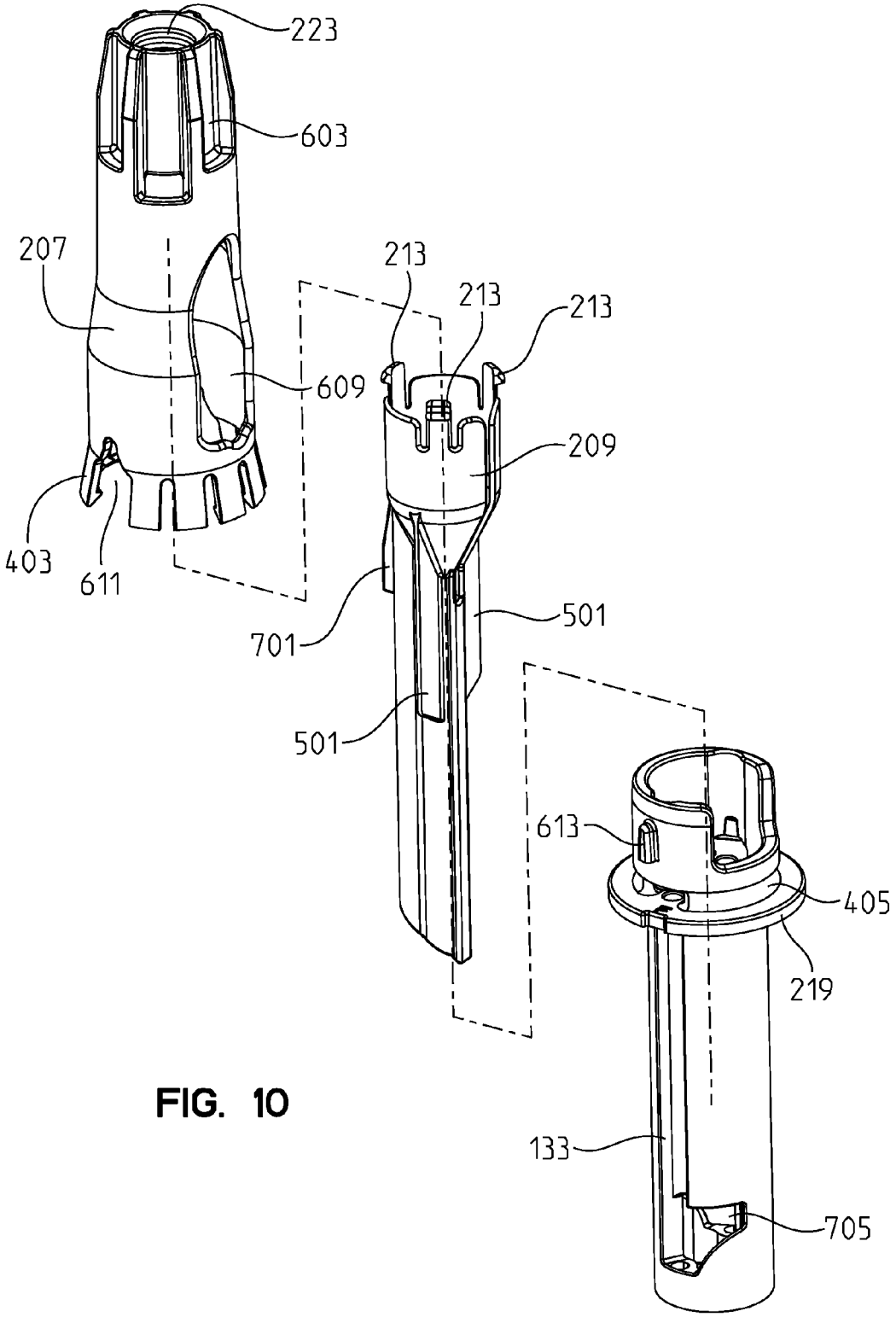
FIG. 10 is an exploded perspective view of a mounting tube, sleeve, and anchor assembly according to an embodiment of the present disclosure.
Figure 11:
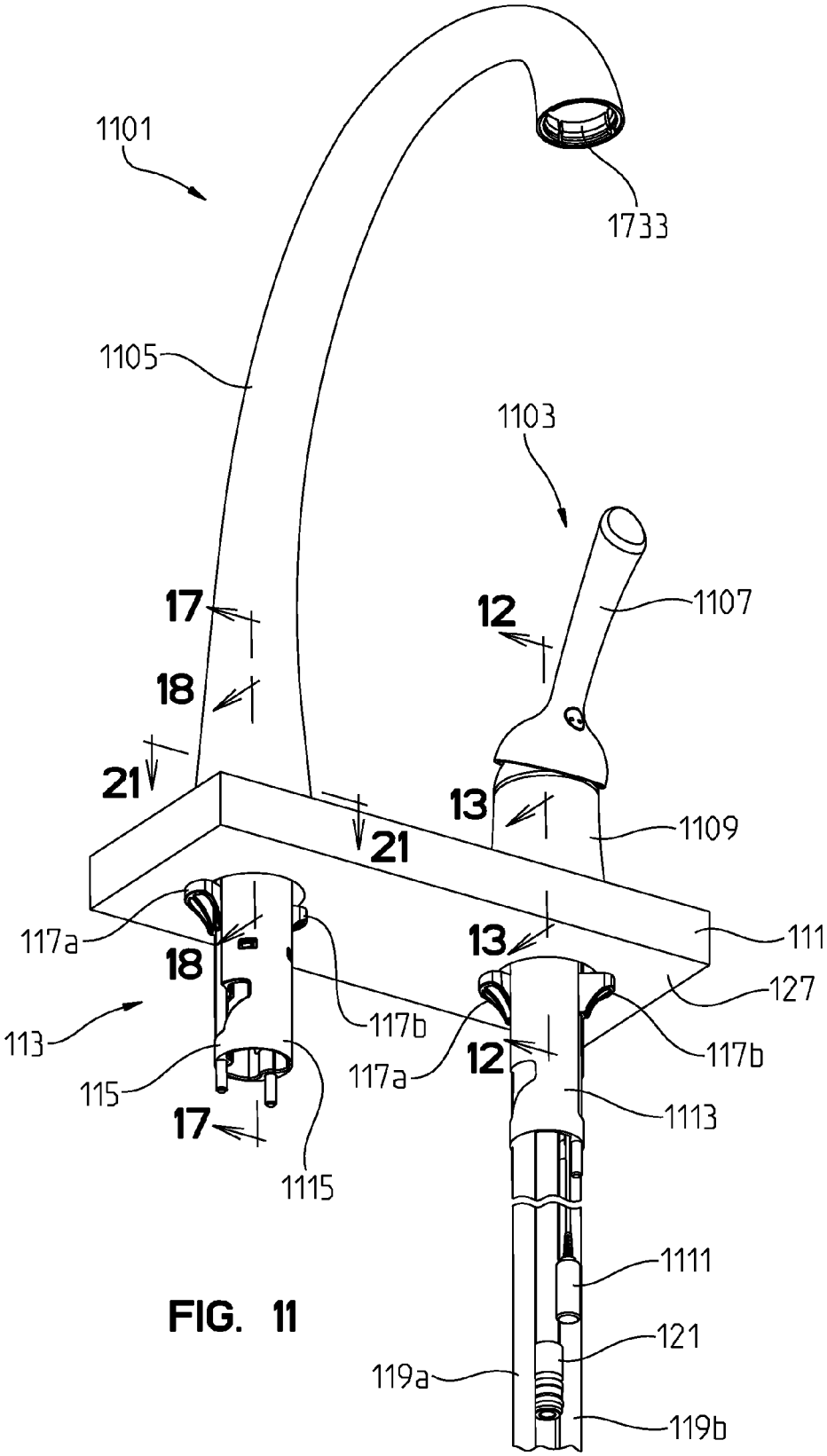
FIG. 11 is a bottom perspective view of a faucet assembly and a handle assembly according to an embodiment of the present disclosure.
Figure 12:
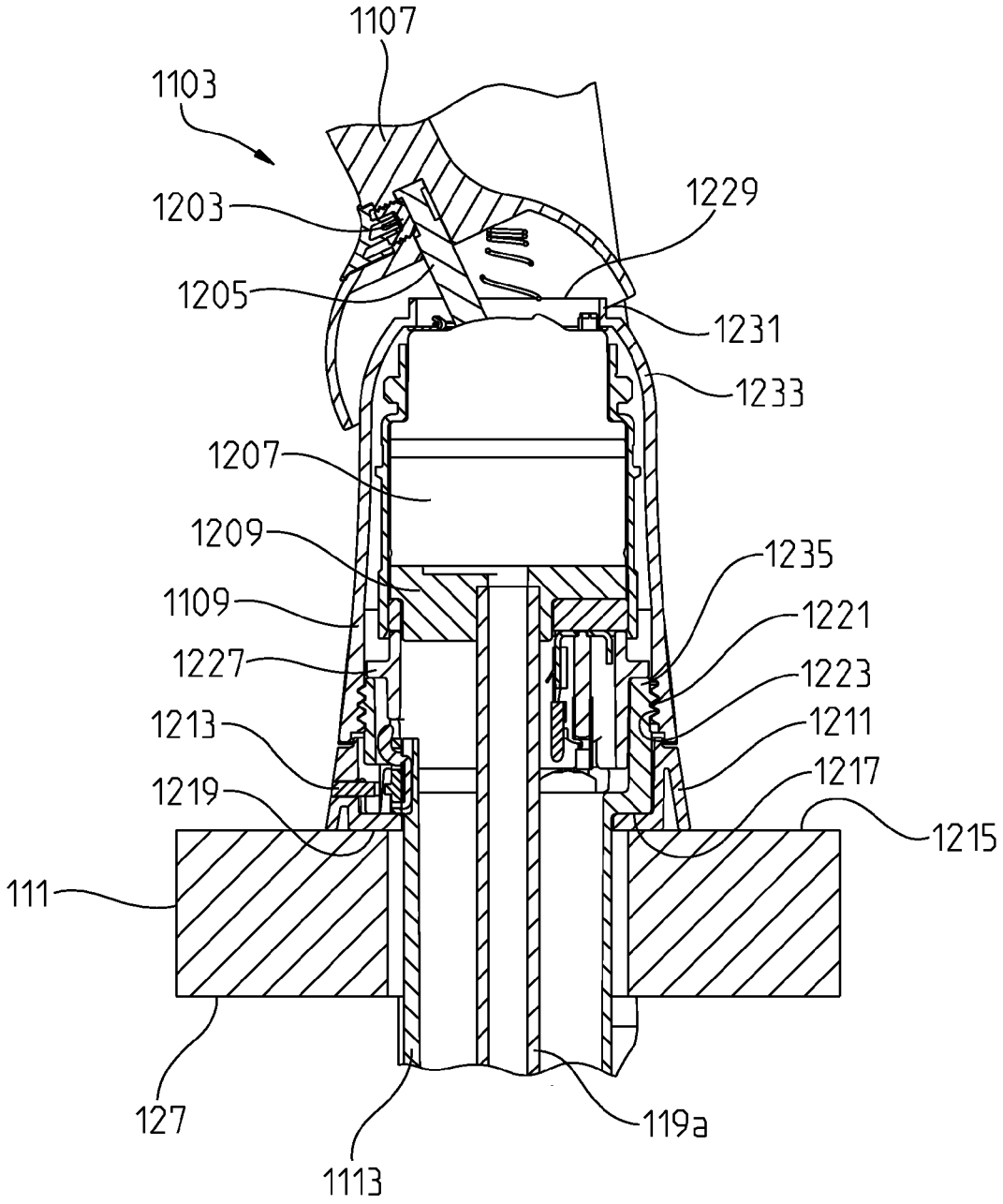
FIG. 12 is a cross-sectional view of the handle assembly taken along line 12-12 of FIG. 11.
Figure 13:
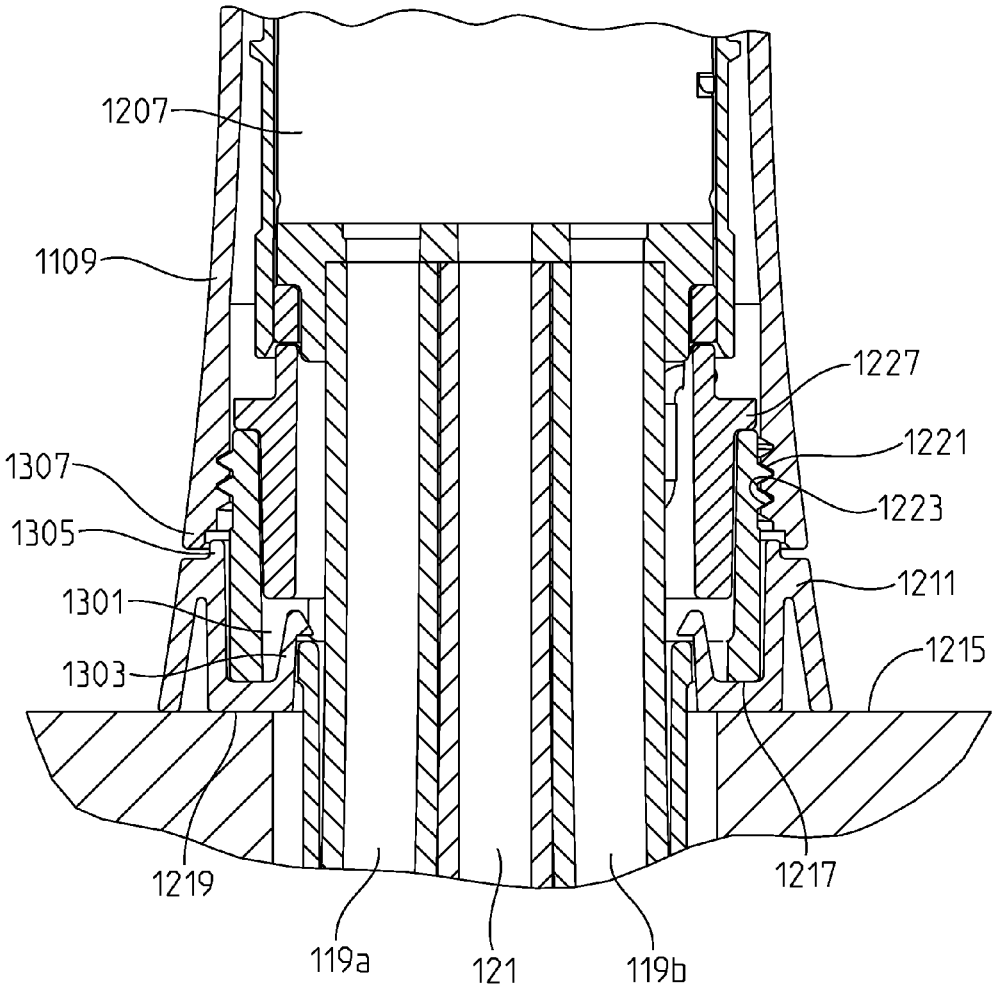
FIG. 13 is a cross-sectional view of the handle assembly taken along line 13-13 of FIG. 11.
Figure 14:
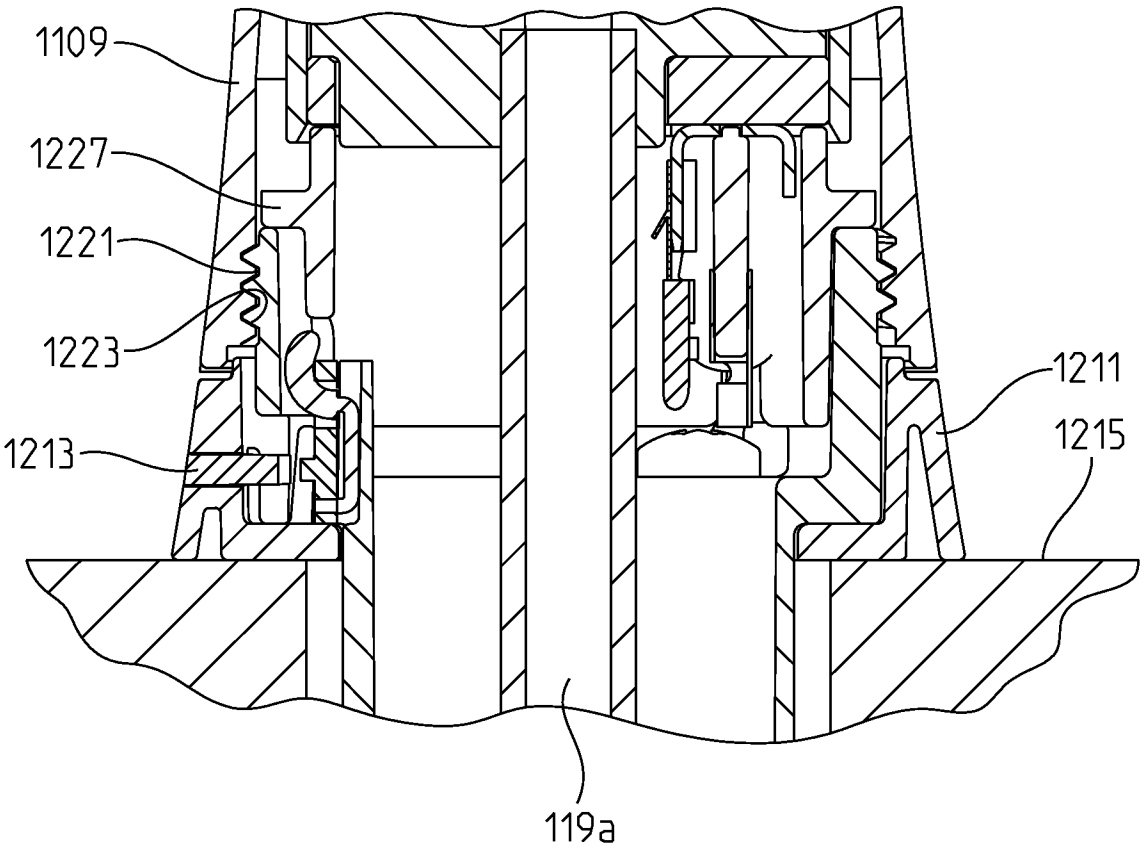
FIG. 14 is a detailed cross-sectional view of a portion of FIG. 12.

With reference to FIGS. 7, 8, and 10, the anchor 115 illustratively includes an anchor floor portion 219 which is mounted from the top of the mounting deck 111 and rests on the upper surface 129 thereof. It should be noted that the anchor 115 may also be mounted from the underside of the mounting deck 111 below its lower surface. The anchor 115 may include a void 707 to receive the waterway assembly 615, or the inlet conduits 119*a* and 119*b* and the outlet conduit 121. The anchor may also comprise one or more projections 613 or other structures for receiving the mounting tube 207 in limited orientations. For example, the projections 613 may receive structures on the mounting tube 207, such as voids 611, to allow the mounting tube 207 to be installed on the anchor 115 in only one orientation.

First and second attachment posts 217*a* and 217*b* extend downwardly from the anchor 115. The attachment posts 217*a* and 217*b* each include a plurality of external threads and are configured to operably couple with the cleats 117*a* and 117*b*. An upper end of each post 217*a* and 217*b* extends through the anchor 115 and includes a head configured to be manipulated by a tool, such as a screwdriver or Allen wrench (not shown). Upper and lower apertures 711 and 709 receive each attachment post 217*a* and 217*b*, respectively. The upper apertures 711 and the lower apertures 709 are formed within the anchor 115. Further, the anchor includes grooves 133 (shown for attachment post 217*a*, not shown for attachment post 217*b*) for each of the attachment posts 217*a* and 217*b*. Grooves 133 are configured to receive the respective attachment post 217*a* and 217*b* and guide the respective cleats 117*a* and 117*b* in movement longitudinally therealong. In one illustrative embodiment, the anchor 115 is formed, for example, through molding of a thermoplastic material.

The mounting plate cleats 117*a* and 117*b* each include a threaded opening configured to threadably engage the respective attachment post 217*a* and 217*b*. Each cleat 117*a* and 117*b* is substantially wedge shaped and includes an upper surface 703 configured to cooperate with the anchor floor portion 219 to clamp the anchor 115 to the mounting deck 111. When the anchor 115 is positioned on the mounting deck 111, the threaded attachment posts 217*a* and 217*b* are rotated to cause the mounting plate cleats 117*a* and 117*b* to move longitudinally up and down on the posts 217*a* and 217*b*, respectively. Illustratively, counterclockwise rotation of attachment posts 217*a* and 217*b* causes cleats 117*a* and 117*b* to move downwardly or away from mounting deck 111 to an unlocked position. The cleats 117*a* and 117*b* may be directed inside of the anchor 115, in a respective support structure (shown as 705 for cleat 117*a*, not shown for cleat 117*b*). The support structures 705 allow the cleats 117*a* and 117*b* to enter the anchor 115 during installation, so that the cleats 117*a* and 117*b* do not interfere with the walls of the void created in the mounting deck 111 to install the anchor 115. The shape of the support structures 705 conform to the cross-sectional shape of cleats 117*a* and 117*b*

Clockwise rotation of attachment posts 217*a* and 217*b* causes cleats 117*a* and 117*b* to move upwardly or toward mounting deck 111 to a locked position. In the locked position, the upper surfaces 703 of the cleats 117*a* and 117*b* abuts the bottom or lower surface 127 of mounting deck 111, securing the anchor 115 thereto.

The cleats 117*a* and 117*b* are prevented from rotating with the attachment posts 217*a* and 217*b* as they are turned, by guide surfaces 711 of each cleat 117*a* and 117*b*. The guide surfaces 711 abut against cooperating stop surfaces 713 of the grooves 133, upon rotation of the cleats 117*a* and 117*b*, respectively. This causes cleats 117*a* and 117*b* to ride up or down the attachment posts 217*a* and 217*b* within the grooves 133 as they are rotated instead of rotating 360 degrees with the rotation of the posts 217*a* and 217*b*. As noted above, attachment posts 217*a* and 217*b* are stabilized and secured at their bottom portions by the anchor 115 body.

The mounting tube 207 (shown particularly in FIGS. 6, 8, 9, and 10) may be formed from a thermoplastic material. The mounting tube 207 is a hollow cylindrical shape and includes a hollow inner portion and an outer portion. The top of the mounting tube 207 may include internal threads 223 disposed on the surface of the inner portion, and the threads 223 of the mounting tube 207 may engage similarly sized external threads 205 on the adapter 201. The diameter of the mounting tube 207 may increase from the top of the mounting tube 207 to the bottom of the mounting tube 207, to conform to the inner shape of the spout 107, and the bottom of the mounting tube 207 may include one or more resilient fingers 403 to secure the mounting tube 207 to the anchor 115. The fingers 403, shown particularly in FIGS. 4, 4A, 6, 8, and 9, may extend outwardly from the longitudinal axis of the mounting tube 207, although may flex inwardly, toward the longitudinal axis of the mounting tube 207, if force is applied to the fingers 403, that is, the fingers 403 may be inwardly biased. The fingers 403 may include a flat surface to engage with the anchor lip 405.

In certain illustrative embodiments, the fingers 403 are biased radially inwardly. The fingers 403 may include one or more projections having an engagement surface 413, shown particularly in FIGS. 4 and 4A, and the engagement surface 413 may releasably engage with the bottom surface of the anchor lip 405. Shown in greater detail below, the diameter of the bottom portion of the mounting tube 207 with the fingers 403 may be larger than the diameter of the anchor body 115, so that the mounting tube 207 may be positioned over the anchor body 115. If force is applied to the outer surface of the mounting tube 207, such as by the delivery spout 107 during installation, the fingers 403 may flex inwardly toward the center of the mounting tube 207. The engagement surface 413 of the fingers 403 may engage the bottom surface of the anchor lip 405, preventing the mounting tube 207 from being removed from the anchor 115 body, shown in FIG. 4A.

The delivery spout 107 (shown in FIGS. 1-4) may be a metal or a plastic material, and may enclose the components of the upper faucet assembly 102, e.g., the outlet tube may be slidably received within the delivery spout 107. The delivery spout 107 may include an opening for the mounting tube 207, an opening for the adapter 201, and an opening for the neck 105. The mixing valve 407 may be disposed within the delivery spout 107, and the mixing valve 407 may be releasably engaged to the delivery spout 107 with a decorative cap 131 or bonnet nut. The decorative cap 131 may include threads that may engage with threads on the mounting body, releasably engaging the delivery spout 107 to the decorative cap 131 and retaining the mixing valve 407 within the delivery spout 107.

The sleeve 209 may be a plastic material, and may by cylindrical and have a hollow inner surface and an outer surface. The center portion of the sleeve 209 may guide the pull-out hose 225 through the mounting tube 207 and through the anchor 115, and the outer surfaces of the sleeve 209, particularly the wings 501 (shown particularly in FIGS. 7, 8, and 10) may guide the inlet conduits 119*a* and 119*b* and the outlet conduit 121 through the mounting tube 207 and through the anchor 115 to the lower surface 127 of the mounting deck 111. Shown in FIG. 5, the wings 501 of the sleeve 209 may position the inlet conduits 119*a* and 119*b* and the outlet conduit 121 so that the inlet conduits 119*a* and 119*b* and the outlet conduit 121 do not tangle or deviate from predefined indentations within the anchor body 115, and ensures that the inlets and the return are separated from the hose 225 positioned within the sleeve 209. The hose 225 within the sleeve 209 may extend and retract as the spray head 103 is uncoupled and removed from the neck 105, and replaced and coupled within the neck 105 during operation. If the hose 225 and the inlet conduits 119*a* and 119*b* and the outlet conduit 121 were not separated, the motion of the hose 225 may scrape and/or wear the inlet conduits 119*a* and 119*b* and the outlet conduit 121. Shown in FIGS. 4 and 6, the sleeve 209 also includes one or more projections 213 at the top of the sleeve 209. The one or more projections 213 releasably engage with one or more voids 603 in the mounting tube 207, so that the sleeve 209 is inserted within the mounting tube 207, and the one or more projections 213 engage with the voids 603 of the mounting tube 207, releasably seating the sleeve 209 within the mounting tube 207.

The waterway assembly 615 includes the inlet conduits 119*a* and 119*b* and the return conduit 121, as well as a coupling element 601 that fluidly couples the inlet conduits 119*a* and 119*b* and the outlet conduit 121 to the mixing valve 407. The inlet conduits 119*a* and 119*b* may each be a hollow tube for carrying liquid from a water source (not shown) to the mixing valve 407. The outlet conduit 121 may be a hollow tube, and may carry liquid from the mixing valve 407 to the spray head 103. The coupling element 601 may form one end of each of the inlet conduits 119*a* and 119*b* and the outlet conduit 121. The coupling element 601 may include a deformable gasket formed from an elastomeric material to seal the inlet conduits 119*a* and 119*b* and the outlet conduit 121 to the mixing valve and separate the inlet conduits 119*a* and 119*b* and the outlet conduit 121 from mixing before reaching the mixing valve 407.

The adapter 201 may be metal or plastic. The adapter 201 may be cylindrical and may include external threads 205 on a lower portion that may threadably engage the internal threads 223 of the mounting tube 207. The adapter 201 may also include one or more projections 301, shown in FIGS. 3 and 8, that engage with the clutch 211, or one or more surfaces 901 that engage with complimentary surfaces 903 on the clutch 211, so that rotation of the adapter 201 may rotate the clutch 211 when the adapter 201 is installed in the clutch 211. The adapter 201 may also include one or more projections 605 that may allow projections 605 on the clutch 211 to releasably engage the adapter 201, holding the adapter 201 in place after installation of the adapter 201. The adapter 201 may include one or more features that may engage projections on the neck adapter 203.

Figure 6:
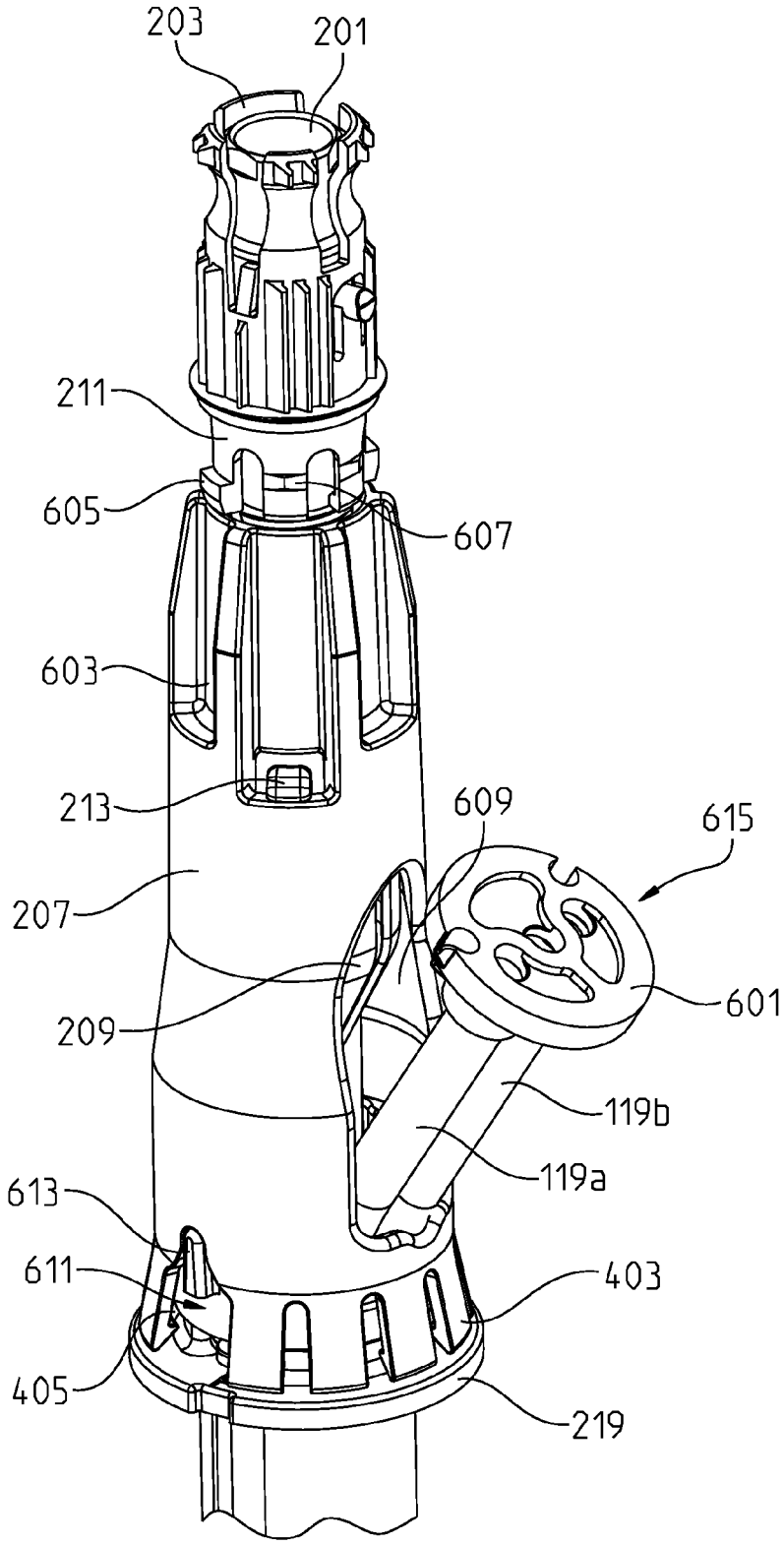
FIG. 6 is a side perspective view of a mounting tube and adapter according to an embodiment of the present disclosure.

Shown in FIGS. 3, 6, and 8, the clutch 211 may be plastic or another material. The clutch 211 may include clutch fingers 605 and clutch projections 607 on the outer surface of the clutch 211 and one or more projections on the inner surface of the clutch. Installed within the delivery spout 107, the clutch fingers 605 may abut a lip 303 or other projection on the inner surface of the delivery spout 107, and may releasably attach the clutch 211 to the delivery spout 107. The inner surface of the delivery spout 107 may be formed such that the clutch projections 607 selectively engage and release the inner surface of the delivery spout 107 when the clutch 211 is rotated within the delivery spout 107. For example, and without limitation, the inner surface of the delivery spout 107 may be hexagonal in shape. The clutch projections 607 may be shaped so that the clutch projections 607 rest in the area formed by the angles of the hexagonal delivery spout 107 inner surface, and resist clockwise or counterclockwise movement. The clutch projections 607 may deform when the clutch 211 is rotated within the delivery spout 107, and may return to an original shape when resting in the area formed by the angles of the hexagonal delivery spout 107 inner surface. The clutch 211 may be rotated within the delivery spout 107, but the clutch 211 may be biased to rest so that the clutch projections 607 rest within the areas formed by the angles of the hexagonal delivery spout 107 inner surface.

The neck adapter 203 may be a plastic material, and may include one or more projections 905 on the outer surface that releasably engage with one or more projections 415 on the inner surface of the neck 105 so that the neck 105 is releasably engaged with the neck adapter 203. The neck adapter 203 may also include one or more projections 305 on the inner surface of the neck adapter 203 that rotatably engage with one or more surfaces 907 of the adapter 201 to allow the neck adapter 203 to rotate freely around the adapter 201, such that rotation of the neck adapter 203 does not rotate the adapter 201 or the clutch 211. When the neck 105 is installed on the neck adapter 203, the neck 105 is in communication with the neck adapter 203, so that rotation of the neck 105 rotates the neck adapter 203. Rotation of the neck adapter 203, however, does not rotate the adapter 201, as the projections 305 of the neck adapter ride in the surfaces 907 of the adapter 201.

The neck 105 may be a metal or plastic material, and may be similar to the material of the delivery spout 107. The neck 105 may be substantially hollow, and may allow the tube to pass through the neck 105.

The spray head 103 may be of a conventional type, and may include a shell or housing formed of a metal or plastic material. The material may be similar to the material of the delivery spout 107 and the neck 105. The spray head 103 may include inserts, such as an aerator and/or nozzles, to provide stream and spray modes for liquid delivery.

Shown in FIG. 8, to mount the anchor 115 onto the mounting deck 111, the mounting adapter is positioned over the opening of the mounting deck 111. In one embodiment, the mounting adapter is not used, and the anchor 115 is mounted directly to the mounting deck 111. To mount the anchor 115, the cleats 117*a* and 117*b* are oriented in retracted positions and are nested within respective supports, and the anchor 115 body is passed through the opening of the mounting adapter and the mounting deck 111 from above. The attachment posts 217*a* and 217*b* are rotated clockwise such that the cleats 117*a* and 117*b* rotate out of the anchor 115 to extended positions outside of respective supports. Continued clockwise rotation causes the cleats 117*a* and 117*b* to move upwardly along the length of the respective post 217*a* and 217*b* such that the upper surfaces 703 of the cleats 117*a* and 117*b* engage the lower surface 127 of the mounting deck 111, and the anchor floor portion 219 engages the mounting adapter, thereby clamping the mounting adapter and the mounting deck 111 between the upper surfaces of the cleats 117*a* and 117*b* and the anchor 115 floor portion 219.

With respect to FIG. 9, the clutch 211 is attached to the delivery spout 107 by pushing the clutch 211 through the top of the delivery spout 107 until the clutch fingers 605 engage with the inner surface of the delivery spout 107. The adapter 201 may be inserted through the opening in the clutch 211, such that the threads 205 of the adapter 201 may extend into the delivery spout 107. Projections on the inner surface of the clutch may releasably engage with the threads 205 of the adapter 201, preventing the adapter 201 from being removed from the delivery spout 107. The adapter 201 and/or the threads 205 of the adapter 201 may be formed so that the rotation of the adapter 201 may rotate the clutch 211. In one embodiment, surfaces 903 inside of the clutch 211 may engage with complimentary surfaces 901 of the adapter 201 in a way that the rotation of the adapter 201 may rotate the clutch 211. The neck adapter 203 may be positioned over the adapter 201, and one or more projections 305 of the neck adapter 203 may releasably engage one or more indentations 907 of the adapter 201. The neck adapter 203 may freely rotate about the adapter 201, so that rotation of the neck adapter 203 does not rotate the clutch 211.

Shown with respect to FIG. 10, the sleeve 209 may be installed within the mounting tube 207. The projections 213 of the sleeve 209 may releasably engage with the voids 603 of the mounting tube 207. The rear wing 701 of the sleeve 209 may abut the inner surface of the mounting tube 207, positioning the sleeve 209 within the mounting tube 207.

The mounting tube 207 may then be positioned within the delivery spout 107. The mounting tube 207 may be positioned so that the mounting tube 207 hose void 609 may be positioned next to the waterway inlet 411 of the delivery spout 107. The inlet conduits 119*a* and 119*b* and the outlet conduit 121 may be inserted through the waterway inlet 411 of the delivery spout 107, and may continue through the mounting tube 207 hose void 609 and into the mounting tube 207. The wings 501 of the sleeve 209 may align the inlet conduits 119*a* and 119*b* and the outlet conduit 121 within the mounting tube 207, and may prevent the inlets and the return from twisting. The threads 205 of the adapter 201 may engage the threads 223 of the mounting tube 207 within the delivery spout 107. The mounting tube 207 may be prevented from rotating 360 degrees within the delivery spout 107 by the inlet conduits 119*a* and 119*b* and the outlet conduit 121 extending through the delivery spout 107 and into the mounting tube 207 through the mounting tube 207 hose void 609. The adapter 201 may be rotated, and the threads 205 of the adapter 201 may engage with the threads 223 of the mounting tube 207. As the mounting tube 207 is constrained from rotating 360 degrees, the mounting tube 207 is drawn into or out of the delivery spout 107 on a longitudinal axis when the adapter 201 is rotated. The mounting tube 207 may be drawn into the delivery spout 107 so that the fingers 403 of the mounting tube 207 may extend from the bottom of the delivery spout 107.

Next, shown with respect to FIGS. 6, 8, and 10, the delivery spout 107, clutch 211, neck adapter 203, adapter 201, mounting tube 207, and inlet conduits 119*a* and 119*b* and outlet conduit 121 are positioned above the anchor 115. The inlet conduits 119*a* and 119*b* and the outlet conduit 121 are positioned so that the inlets and the return extend out of the bottom of the delivery spout 107, to the upper surface 129 of the mounting deck 111, through the mounting adapter, through the anchor 115, and to the lower surface 127 of the mounting deck 111. The opening of the mounting tube 207 is sized to be larger than the upper portion of the anchor 115. The projections 613 of the anchor 115 may be positioned within the voids 611 located in the mounting tube 207, so that the mounting tube 207 may be positioned over the anchor 115 in one orientation. The fingers 403 of the mounting tube 207 may be positioned to abut the anchor 115 floor portion 219, and may rest on the anchor 115 floor portion 219.

The adapter 201 may be rotated, so that the threads 205 of the adapter 201 engage the threads 223 of the mounting tube 207. The neck adapter 203 may be positioned around the portion of the adapter 201 extending out of the delivery spout 107, so that the rotation of the adapter 201 may include the use of a tool able to releasably engage with one or more structures on the adapter 201. In one embodiment, one or more voids in the adapter 201 may engage with one or more projections of a tool, to enable the tool to rotate the adapter 201. The engagement of the threads 205 of the adapter 201 and the threads 223 of the mounting tube 207 may move the mounting tube 207 into the delivery spout 107. The opening of the delivery spout 107 may be narrower than the opening of the mounting tube 207, so that when the mounting tube 207 is drawn into the delivery spout 107, the fingers 403 of the mounting tube 207 may be pressed together by the narrower delivery spout 107. The fingers 403 may close together, so that the diameter of the mounting tube 207 opening may become smaller. The fingers 403 may engage with the lip 405 of the anchor 115 as the diameter of the mounting tube 207 becomes smaller. The adapter 201 may continue to be rotated until the body indentation 221 abuts the anchor floor 219, as shown in FIGS. 2 and 3. The fingers 403 engaged with the lip 405 of the anchor 115 may prevent the delivery spout 107 from being removed from the anchor 115. When the body indentation 221 abuts the anchor floor 219, the adapter 201 may not be able to be rotated further, which may prevent overtightening. When the body indentation 221 abuts the anchor floor 219, the delivery spout 107 may substantially abut the upper surface of the mounting adapter or the upper surface of the mounting deck 111. When the body indentation 221 abuts the anchor floor 405, the tool may be removed.

If the delivery spout 107 is to be removed from the anchor 115, for example for refitting or deinstallation, the adapter 201 may be rotated in the opposite direction as the adapter 201 was rotated to install the delivery spout 107 to the anchor 115. The threads 205 of the adapter 201 may engage with the threads 223 of the mounting tube 207, and may move the mounting tube 207 away from the adapter 201, and out of the delivery spout 107. Moving the mounting tube 207 away from the adapter 201 may cause the fingers 403 to expand away from one another as they become disengaged from the lip 405 of the anchor 115. The diameter of the opening of the mounting tube 207 may increase, and the diameter increase may allow the fingers 403 to become disengaged from the lip 405 of the anchor 115. The mounting tube 207 and delivery spout 107 may be removed from the anchor 115 when the fingers 403 are disengaged from the lip 405 of the anchor 115.

The anchor 115 may also be removed from the mounting deck 111. To remove the anchor 115, the attachment posts 217*a* and 217*b* are rotated counterclockwise, so that the cleats 117*a* and 117*b* move downwardly along the length of the posts 217*a* and 217*b*, disengaging the cleats 117*a* and 117*b* from the lower surface of the mounting deck 111. The posts may continue to be rotated counterclockwise, and the cleats 117*a* and 117*b* may continue to move downwardly along the length of the posts until the cleats 117*a* and 117*b* reach their respective supports 705, and rotate into the anchor 115 within the supports 705. The anchor 115 may then be lifted out of the hole in the mounting deck 111. The mounting adapter may be removed from the mounting deck 111 as well.

In an alternate embodiment, shown in FIGS. 11-21, a further illustrative spout including a delivery spout and a handle are shown mounted to mounting deck 111. With respect to FIG. 11, the valve structure 1103 is mounted to the mounting deck 111. Inlet conduits 119*a* and 119*b* carry fluid from below the mounting deck 111, through the valve anchor structure 1113, and to a valve, where the fluids are mixed in a proportion selected by the valve, and the combined fluids are passed in an outlet conduit through the valve anchor structure 1113 and below the mounting deck 111. The spout structure 1101 is mounted to the mounting deck 111 beside the valve structure 1103 with a spout anchor structure 1115, which allows the return conduit to pass through the spout anchor structure 1115 and into the spout structure 1101.

The spout structure 1101 and the valve structure 1103 are mounted to the mounting deck 111 with a spout anchor structure 1115 and a valve anchor structure 1113, respectively. The spout structure 1101 and the valve structure 1103 are shown together mounted to a mounting deck in FIG. 11.

With respect to the valve structure 1103, shown in FIGS. 11-16, the anchor structure 1113 for the handle may be similar to the anchor 113 previously shown, however instead of an anchor lip 405 securing the mounting tube 207, the valve anchor 1113 may provide external threads 1223 to releasably secure the housing 1109 to the valve anchor 1113. The valve anchor cleats 117*a* and 117*b* may releasably engage the bottom surface 127 of the mounting deck 111, and, in an embodiment, may include a ring 1211 separating the bottom surface of the anchor 1113 with the top surface 1215 of the mounting deck 111, so that the ring 1211 is engaged with the top surface 1215 of the mounting deck 111 and the surface of the anchor 1113. The anchor threads 1223 may be used to releasably secure the housing 1109 to the valve anchor 1113, and thus the valve structure 1103 to the valve anchor 1113, as more fully explained below.

The ring 1211 may be a metal or plastic ring, and has an internal void so that the ring 1211 surrounds the valve anchor 1113, and is located adjacent to the upper surface 1215 of the mounting deck. In the embodiment shown in FIG. 13, the ring 1211 includes ring snap fingers 1303 that extend through the valve anchor 1113 at anchor openings 1303, and releasably engage with the valve anchor 1113 to secure the ring 1211 to the valve anchor 1113. The ring 1211 may include a lip 1305 that may interface with a complimentary lip 1307 on the housing 1109 to prevent the valve anchor 1113 from being seen from outside of the housing 1109 when the housing 1109 is installed on the valve anchor 1113.

Figure 15:
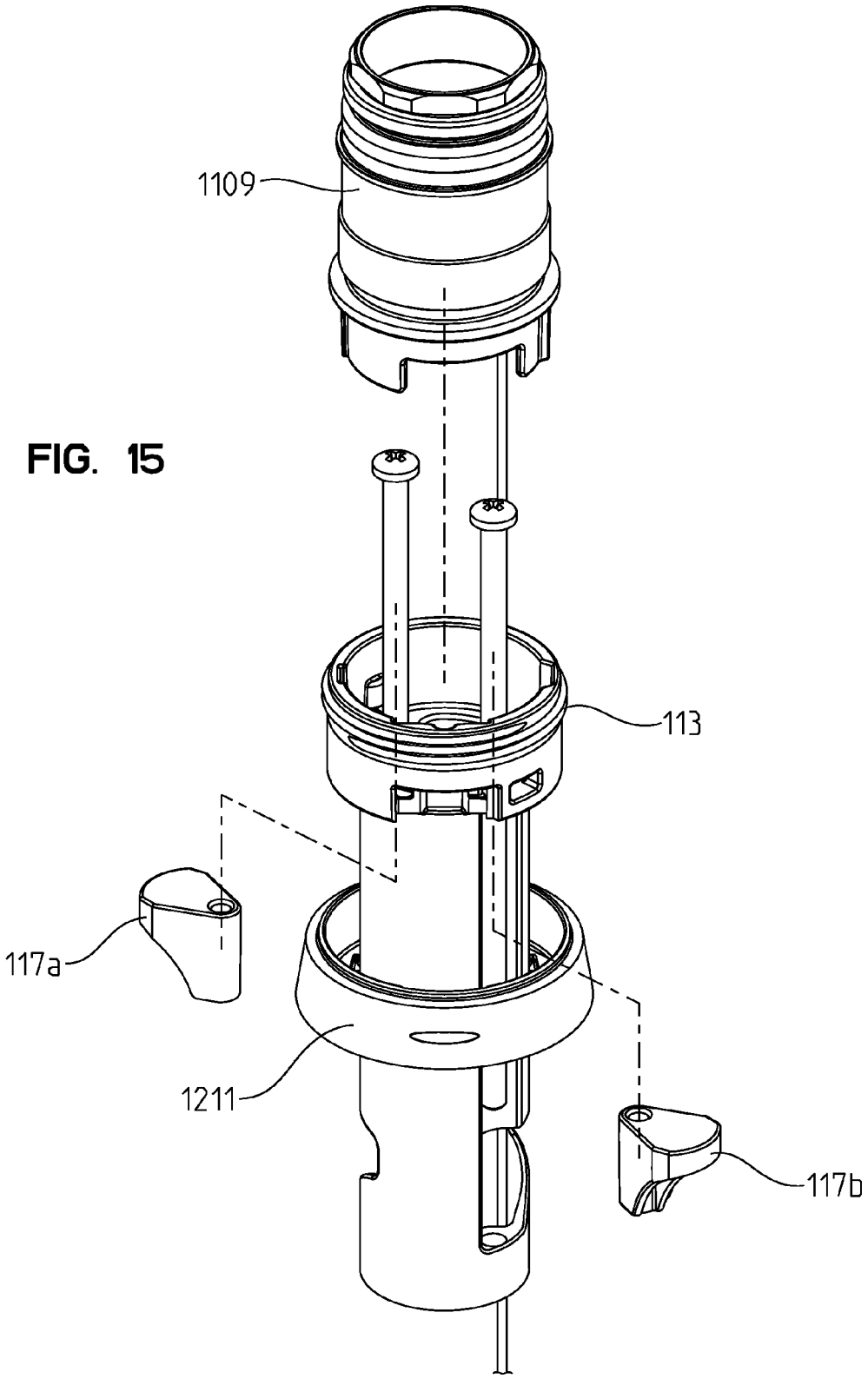
FIG. 15 is an exploded perspective view of the anchor and top mounting structure of the handle assembly of FIG. 11.
Figure 16:
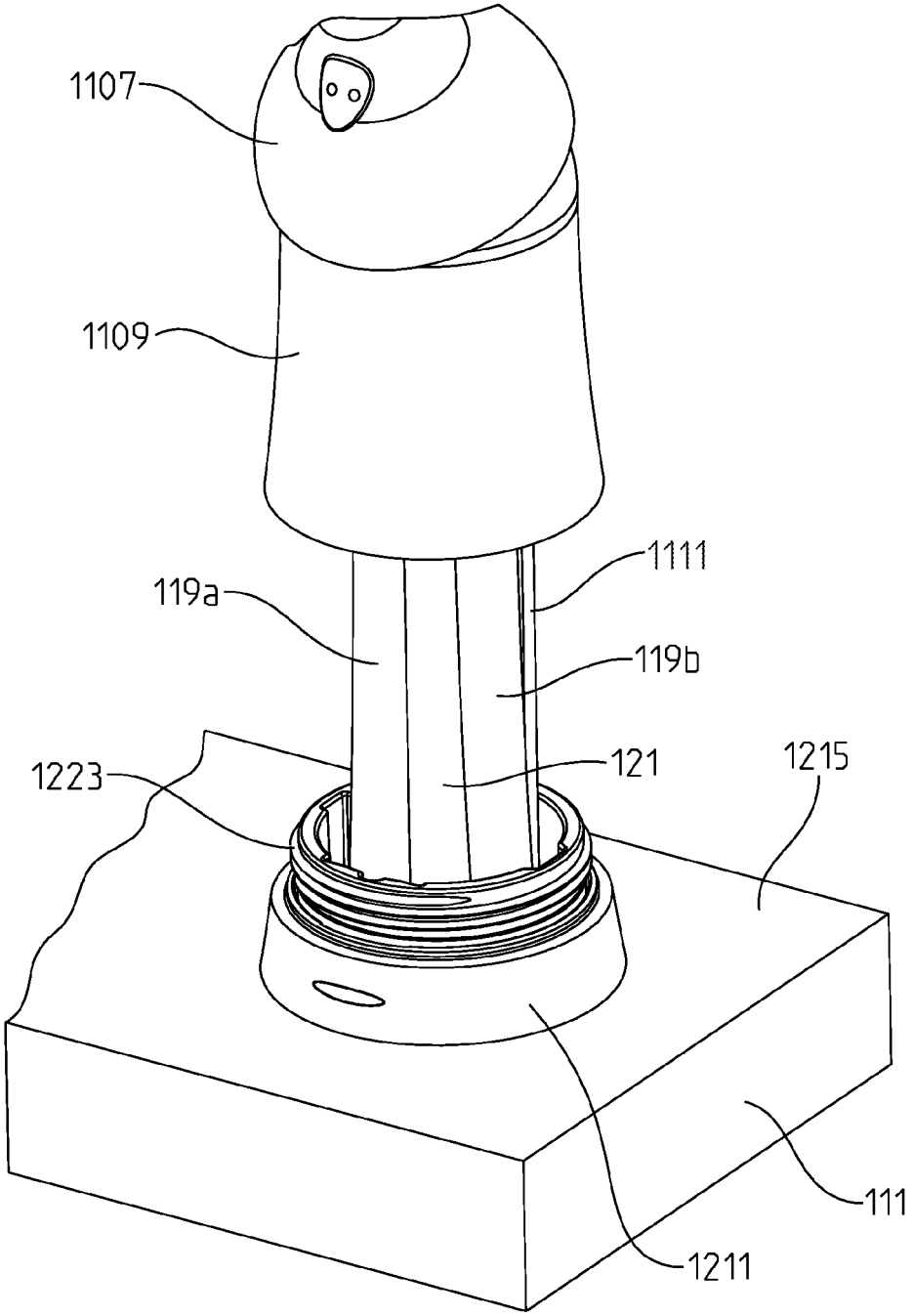
FIG. 16 is top perspective view of the anchor and top mounting structure of the handle assembly of FIG. 11.
Figure 17:
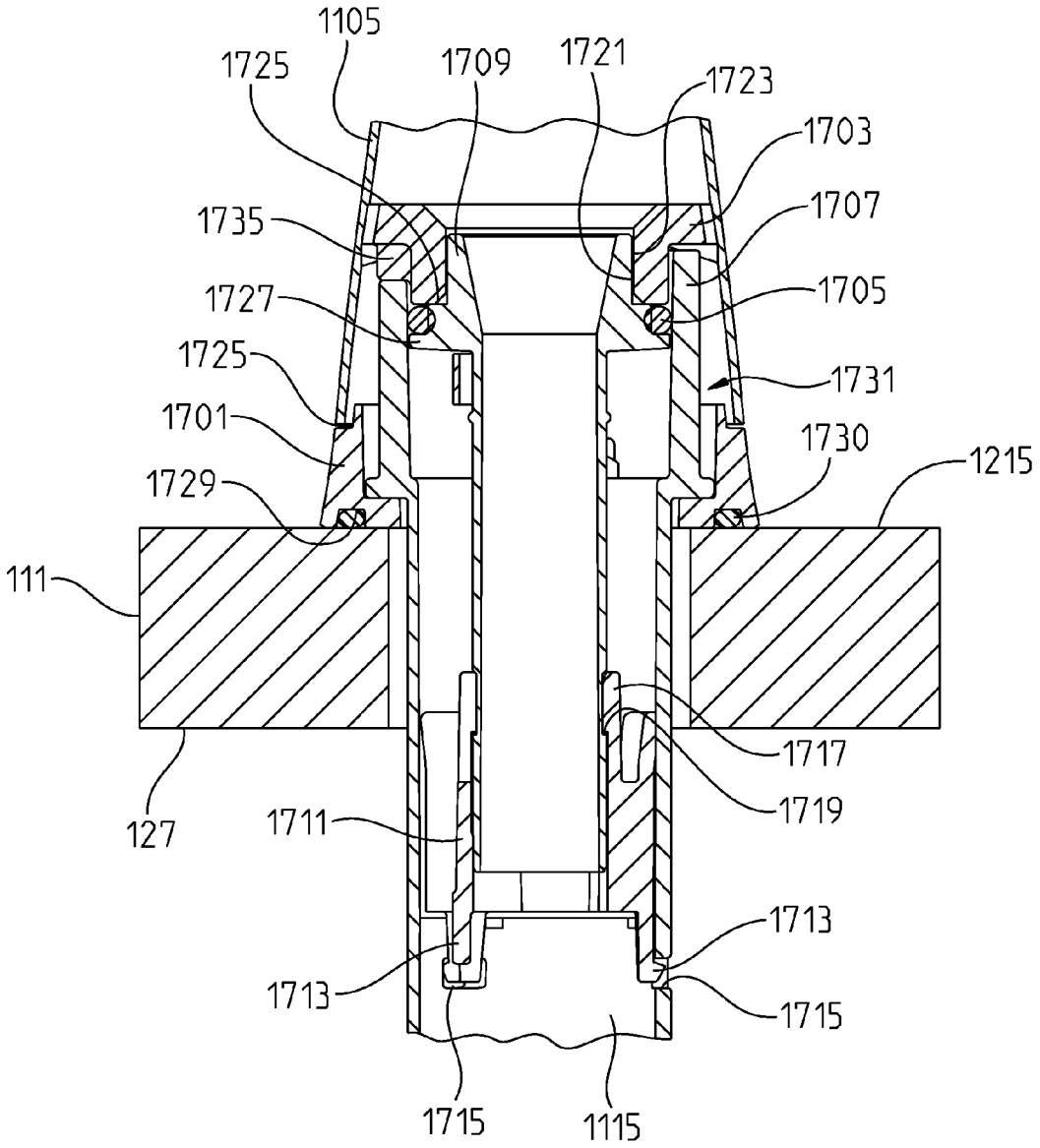
FIG. 17 is a cross sectional view of the faucet taken along line 17-17 of FIG. 11.
Figure 18:
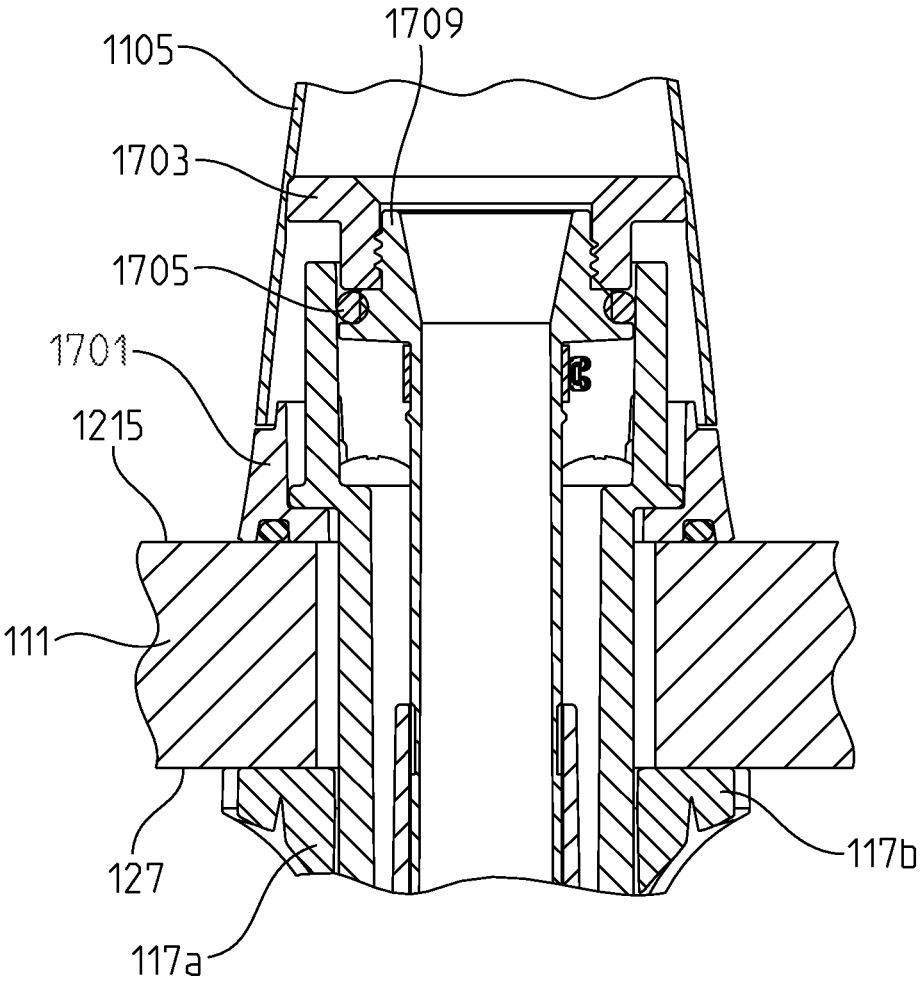
FIG. 18 is a detailed cross-sectional view of a portion of FIG. 17.
Figure 19:
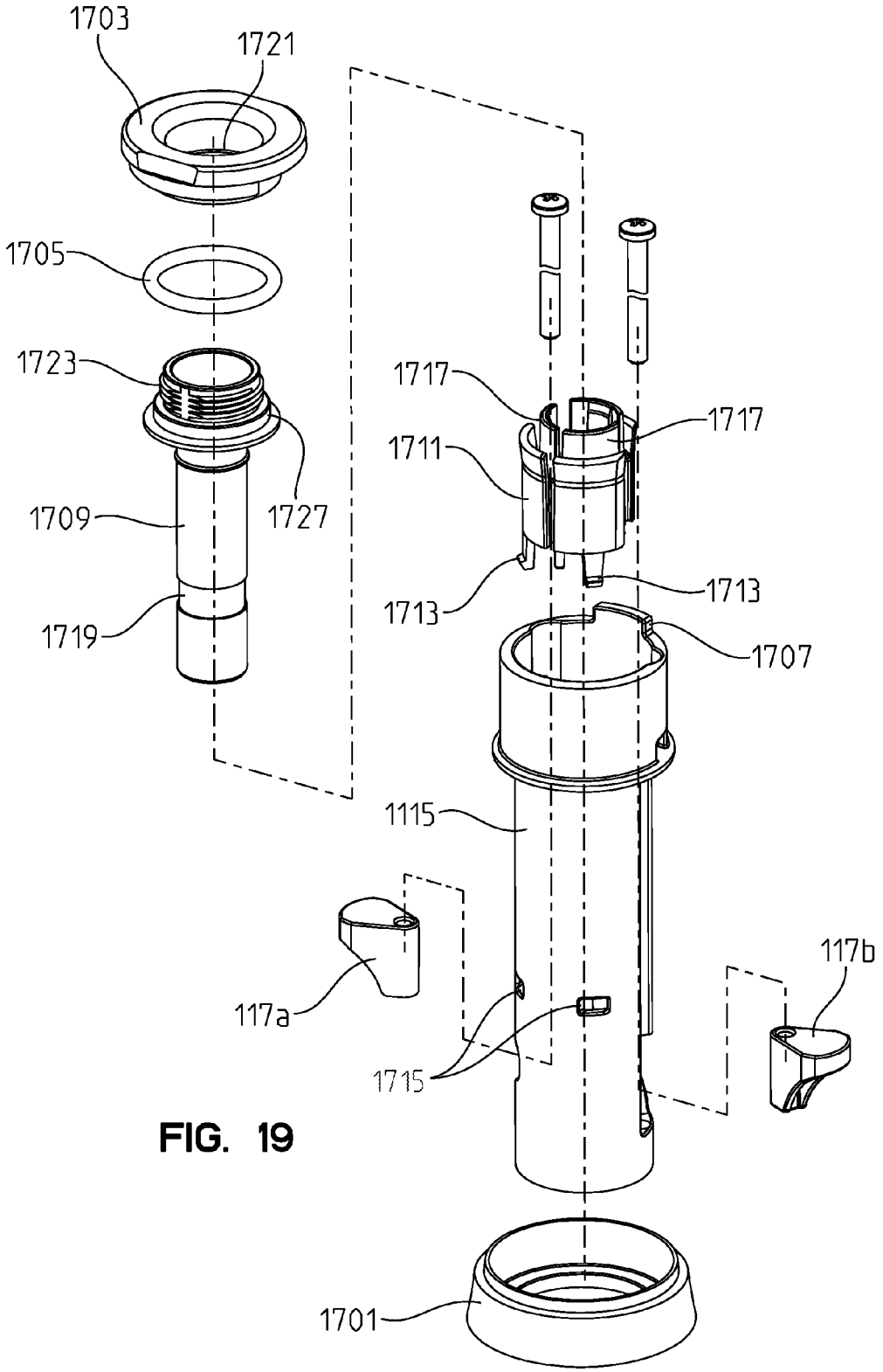
FIG. 19 is an exploded perspective view of the anchor and bearing of FIG. 19.
Figure 20:
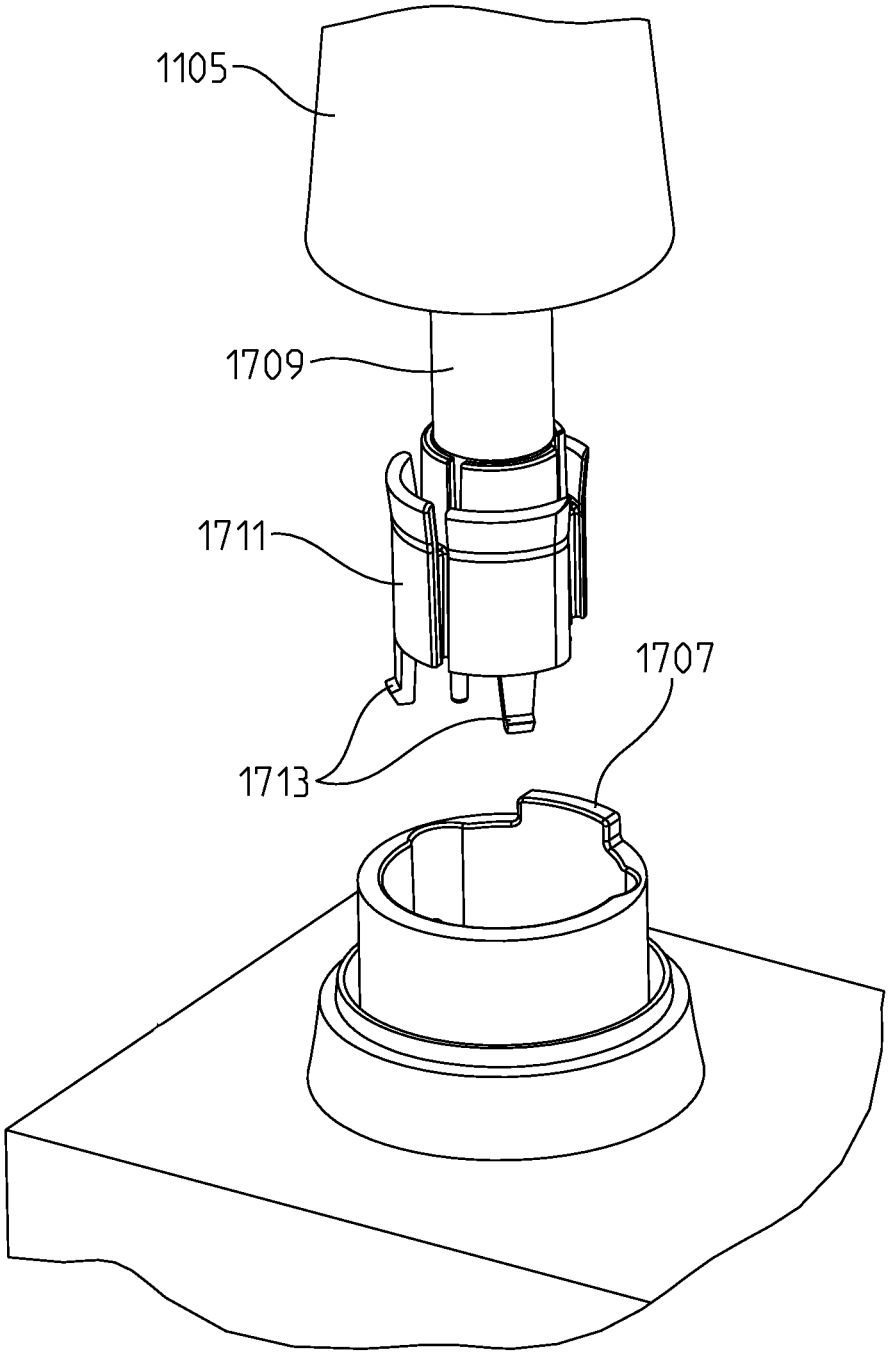
FIG. 20 is a top view of the faucet with bearing and the anchor according to an embodiment of the present disclosure.
Figure 21:
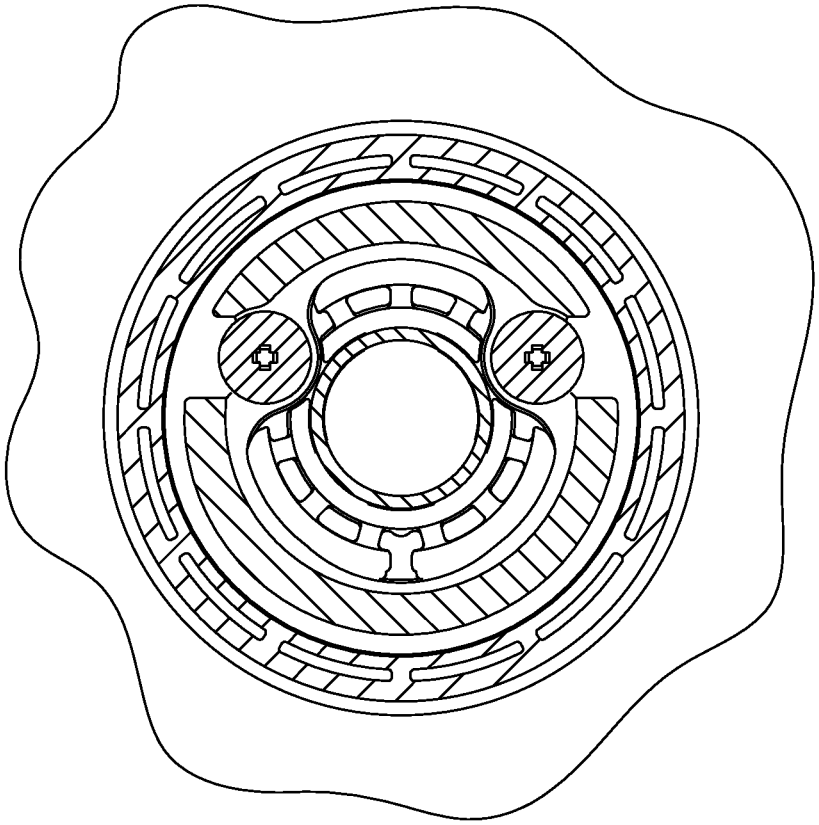
FIG. 21 is a cross sectional view of the anchor structure of the faucet taken along line 21-21 of FIG. 11.

Inlet conduits 119*a* and 119*b* shown in FIGS. 15 and 16 may supply, for example, water from hot and cold water sources (not shown) to the mixing valve 1207. The mixing valve 1207 may adjust the flow from the inlet conduits 119*a* and 119*b* based on the position of the stem 1205, and the mixed sources may flow into the outlet conduit 121.

The mixing valve 1207, in the embodiment, is in communication with a keying ring 1227 that surrounds the mixing valve 1207. In the embodiment, the keying ring 1227 is fixed with respect to the mixing valve 1207. The keying ring 1227 has an internal void to allow the inlet conduits 119*a* and 119*b* and the outlet conduit 121 to pass through, and includes one or more projections or indentations that interact with complimentary projections or indentations on the valve anchor 1113, so that the projections or indentations on the keying ring 1227 and on the valve anchor 1113 fit together in only one orientation. That is, the keying ring 1227 and the mixing valve 1207 that the keying ring 1227 is fixed to must be rotated until the projections or indentations of the keying ring 1227 match with the complimentary projections or indentations of the valve anchor 1113, allowing the mixing valve 1207 to fit into the valve anchor 1113 in one orientation.

The housing 1109 may be a metal or a plastic, and may be in the shape of a cylinder. The first opening 1235 includes threads 1221 disposed on the inner surface of the housing 1109, which are adapted to engage threads 1223 located on the valve anchor 1113. The surface of the housing 1109 near the second opening 1229 curves inward at 1231, so that the second opening 1229 is a smaller diameter than the first opening 1235. The narrowing diameter of the housing 1109 from the first opening 1235 to the second opening 1229 forms a portion of the inner surface 1231 that retains the mixing valve 1207 during installation, preventing the mixing valve 1207 from being removed from the second opening 1229. In an embodiment, the outer surface of the second opening 1229 contains projections or indentations that may engage a tool with complimentary projections or indentations, so that the tool may releasably grip the outer surface and allow the tool to rotate the housing 1109. The stem 1205 of the mixing valve 1207 extends through the second opening 1229.

During installation of the handle assembly 1103, the mixing valve 1207 and the keying ring 1227 are positioned within the housing 1109 so that the stem 1205 of the mixing valve 1207 extends out of the second opening 1229 of the housing 1109. The mixing valve 1207 may be inserted into the housing 1109 through the first opening 1235, as the second opening 1229 is dimensioned to be too narrow for the mixing valve 1207 to pass through.

The ring 1211 is pressed onto the bottom surface of the valve anchor 1113, so that the ring snap fingers 1303 flex outwardly and pass through the anchor openings 1301. When the projections on the ring snap fingers 1303 reach the inner surface of the valve anchor 1113 through the anchor openings 1301, the ring snap fingers 1303 flex inwardly so that the projections abut the inner surface of the valve anchor 1113, releasably fixing the ring 1211 to the valve anchor 1113.

To mount the valve anchor 1113 onto the mounting deck 111, the cleats 117*a* and 117*b* are oriented in retracted positions and are nested within respective supports, and the anchor 1113 is passed through the mounting deck 111 from above. The ring bottom surface 1219 is sized so that it is wider than the opening through the mounting deck 111, or additional material is used to fill in the opening through the mounting deck so that the ring bottom surface 1219 contacts the upper surface 1215 of the mounting deck 111. The attachment posts 217*a* and 217*b* are rotated clockwise such that the cleats 117*a* and 117*b* rotate out of the anchor 115 to extended positions outside of respective supports. Continued clockwise rotation causes the cleats 117*a* and 117*b* to move upwardly along the length of the respective post 217*a* and 217*b* such that the upper surfaces 703 of the cleats 117*a* and 117*b* engage the lower surface 127 of the mounting deck 111, and the anchor floor portion 219 engages the mounting adapter, thereby clamping the mounting adapter and the mounting deck 111 between the upper surfaces of the cleats 117*a* and 117*b* and the anchor 115 floor portion 219.

The inlet conduits 119*a* and 119*b*, shown in FIGS. 15 and 16, and the outlet conduit 121 are positioned to extend through the void in the anchor 1113 from the top surface 1215 of the mounting deck 111 to the bottom surface 127 of the mounting deck 111. The mixing valve 1207 and the housing 1109 are positioned so that the projections or indentations of the keying ring 1227 match with the projections or indentations of the anchor 1113, indicating a correct positioning of the keying ring 1227 and the mixing valve 1207. The inner threads 1221 of the housing 1109 contact the outer threads 1223 of the anchor 1113, and the housing 1109 is rotated so that the inner threads 1221 of the housing 1109 and the outer threads 1223 of the anchor 1113 are in communication with one another. The housing 1109 may be tightened by a tool (not shown). When tightened, the lip 1307 of the housing 1109 is positioned over the lip 1305 of the anchor 1113, obstructing the view of the anchor 1113 from the outside of the valve structure 1103. The handle 1107 is attached to the stem 1205 and held in place with a set screw 1203. A user may operate the handle 1107 to manipulate the stem 1205 and the mixing valve 1207 to change flow and the mixture of liquid from the inlet conduits 119*a* and 119*b* to the outlet conduit 121.

The spout structure 1101, shown in FIGS. 11 and 17-21, may also be mounted to the mounting deck. The spout structure 1101 is mounted to the deck with a spout anchor structure 1115, described below.

The anchor structure 1115 for the spout 1105 may be similar to the anchor structure 113 previously shown, however instead of an anchor lip 405 securing the mounting tube 207, the spout anchor 1115 may contain one or more windows 1715 to provide a releasable attachment for one or more fingers 1713 of a bearing 1711 in communication with the spout structure 1101. The spout anchor cleats 117*a* and 117*b* may releasably engage the bottom surface 127 of the mounting deck 111, and, in an embodiment, may include an insulator ring 1701 separating the top surface of the anchor 1103 from the top surface 1215 of the mounting deck 111, so that the ring 1701 is engaged with the top surface 1215 of the mounting deck 111 and the anchor 1103.

The ring 1701 is illustratively formed of a non-conductive material (e.g., electrically non-conductive plastic), and has an internal void so that the ring 1701 surrounds the anchor 1115, and is located adjacent to the upper surface 1215 of the mounting deck 111. In an embodiment, the ring 1701 includes ring snap fingers (not shown) that extend through the anchor 1115 at anchor openings (not shown), and releasably engage with the anchor 1115 to secure the ring 1701 to the anchor 1115. The ring 1701 may include a lip 1725 that may interface with the first opening of the spout 1105 to prevent the anchor 1115 from being seen from outside of the spout 1105 when the spout 1105 is installed on the anchor 1115. The ring 1701 may also include a groove 1729 into which may be disposed an elastomeric or foam gasket 1730. The elastomeric or foam gasket 1730 may extend below the lower surface of the ring 1701, so that it may be in contact with the upper surface 1215 of the mounting deck 111. The elastomeric or foam gasket 1730 may deform during installation to create a seal between the ring 1701 and the upper surface 1215 of the mounting deck 111. In an embodiment, the elastomeric or foam gasket 1730 may be formed in a different shape, and may include one or more projections interacting with the groove 1729 to hold the member in place when positioned on the ring 1701.

A set ring 1721 may be received within with the spout 1105, and may, in an embodiment, be fixed in the spout 1105 by brazing or other permanent mounting. The set ring 1721 may be fixed in relation to the spout 1105 so that when the spout 1105 rotates, the set ring 1721 also rotates. The set ring 1721 may be cylindrical and may have an internal void. The set ring 1721 contains a portion 1735 that interferes with a projection 1707 on the anchor to form a limit stop, preventing the spout 1105 from a full range of rotation about the anchor 1115. The set ring 1721 contains threads 1721 positioned on the inner surface of the set ring 1721, which interact with external threads 1723 on the connector tube 1709.

The connector tube 1709 may be a metal, such as brass. The connector tube 1709 is cylindrical and hollow, and contains tube threads 1723 located on the outer surface. The tube threads 1723 engage with the threads 1721 of the set ring 1703, releasably engaging the connector tube 1709 to the set ring 1703. The connector tube 1709 also contains a groove 1727 or a tube lip into which an elastomeric o-ring 1705 may be deposited. The o-ring 1705 may be sized so that it deforms when installed and the connector tube 1709 presses the o-ring 1705 against the inner surface of the anchor 1115. Proximate on opposite end of the connector tube 1709 as the threads 1723, the connector tube 1709 contains a groove 1719 to interact with one or more fingers 1717 of the bearing 1711, allowing the bearing 1711 to rotate relative to the connector tube 1709.

The bearing 1711 is cylindrical, and may be formed of a plastic material. The bearing 1711 contains inward facing fingers 1717 and outward facing fingers 1713. The inward facing fingers 1717 engage with the groove 1719 on the outer surface of the connector tube 1709, such that the connector tube 1709 may rotate freely around the bearing 1711. When the connector tube 1709 and bearing 1711 are installed within the anchor 1115, the outward facing fingers 1713 flex inward while the bearing 1711 travels the length of the anchor 1115, and flex outward to engage with the anchor windows 1715. The outward facing fingers 1713 are angled so that an amount of upward force will flex the outward facing fingers 1713 inwardly and remove the outward facing fingers 1713 from the anchor windows 1715. The inward facing fingers 1717 are angled so that disengagement of the inward facing fingers 1717 from the groove 1719 on the outer surface of the connector tube 1709 requires more force than disengagement of the outward facing fingers 1713 from the anchor windows 1715. This allows for disassembly or removal, so that the user may apply upward force to the spout 1105, and the outward facing fingers 1713 disengage from the anchor windows 1715 before the inward facing fingers 1717 disengage from the groove 1719 on the outer surface of the connector tube 1709, allowing the bearing 1711 to remain in communication with the connector tube 1709 while the connector tube 1709 and spout 1105 are lifted out of the anchor 1115.

The spout 1105 may be a metal or a plastic, and may be in the shape of a cylinder. The spout 1105 is hollow to allow for the outlet conduit 121 to extend from the bottom surface 127 of the mounting deck, through the anchor 1115, through the connector tube 1709, into the first opening 1731 of the spout 1105, through the spout 1105, and to the second opening 1733 of the spout 1105. The outlet conduit 121 may terminate with an aerator or other liquid management device. In an embodiment, the outlet conduit 121 is fixed within the spout 1105. In another embodiment, the outlet conduit 121 is not fixed, may be attached to a removable device such as a sprayer, and may be pulled out of the second opening 1733.

During installation of the spout assembly 1101, the set ring 1703 is fixed within the spout 1105, near the first opening 1731. The connector tube 1709 is installed in the spout 1105, so that the threads of the connector tube 1709 engage with the threads of the set ring 1703. The o-ring 1705 may be placed on the tube, 1709 and be partially constrained by a lip 1727 or other projection on the connector tube 1709.

The ring 1701 is pressed onto the bottom surface of the anchor 1115, so that the ring snap fingers flex outwardly and pass through the anchor openings. When the projections on the ring snap fingers reach the inner surface of the anchor through the anchor openings, the ring snap fingers flex inwardly so that the projections abut the inner surface of the anchor, releasably fixing the ring 1701 to the anchor 1115. The elastomeric or foam ring (not shown) may be placed in the groove 1729 on the underside of the ring 1701.

To mount the anchor 1115, the cleats 117*a* and 117*b* are oriented in retracted positions and are nested within respective supports, and the anchor 1115 body is passed through the mounting deck 111 from above. The ring 1701 bottom surface is sized so that it is wider than the opening through the mounting deck 111, or additional material is used to fill in the opening through the mounting deck 111 so that the ring 1701 bottom surface contacts the upper surface 1215 of the mounting deck 111. The attachment posts 217*a* and 217*b* are rotated clockwise such that the cleats 117*a* and 117*b* rotate out of the anchor 115 to extended positions outside of respective supports. Continued clockwise rotation causes the cleats 117*a* and 117*b* to move upwardly along the length of the respective post 217*a* and 217*b* such that the upper surfaces 703 of the cleats 117*a* and 117*b* engage the lower surface 127 of the mounting deck 111, thereby clamping the anchor 1115 and the mounting deck 111 between the upper surfaces of the cleats 117*a* and 117*b* and the anchor 1115.

The outlet conduit 121 is positioned to extend through the void in the anchor 1115 from the top surface 1215 of the mounting deck 111 to the bottom surface 127 of the mounting deck. The spout assembly 1101 is positioned over the anchor 1115 so that the connector tube 1709 extends into the void of the anchor, and the anchor projections 1707 compliment the projections of the ring. The outward facing fingers 1717 of the bearing 1711 flex inward while the bearing 1711 is moved through the void of the anchor 1115, and the outward facing fingers 1713 of the bearing 1711 flex outward when the fingers 1713 interact with the anchor windows 1715. The spout 1105 may overlap the lip 1725 of the ring 1701, so that the anchor 1701 is not visible from the upper surface 1215 of the mounting deck 111. The user may rotate the spout 1105, rotating the set ring 1703 and rotating the connector tube 1709, and the bearing 1711 may stay static with respect to the connector tube 1709, as the bearing 1711 is releasably fixed to the anchor 1115, but the spout 1105 is prevented from over rotation by the interactions of the projections 1707 of the anchor 1115 and the projections of the set ring 1703. The inward facing fingers 1717 of the bearing 1711 prevent upward and downward movement of the spout assembly 1101, although the outward facing fingers 1713 may decouple from the anchor windows 1715 during disassembly or removal.

The spout structure 1101 and/or the valve structure 1103 may include capacitive sensors. The valve structure 1103 may include, for example, a light emitting diode indicator 1213 to provide the status of the capacitive sensor. Connector 1111 may extend from the valve structure 1103 and through the anchor 1113 to connect with a processor (not shown).

Although the disclosure has been described in detail with reference to certain preferred embodiments, variations and modifications exist within the spirit and scope of the disclosure as described and defined in the following claims.

The invention claimed is:

1. A faucet assembly comprising:

an anchor including a mounting body extending between opposing upper and lower ends, the upper end of the mounting body including a retaining lip;

a faucet support positioned above the anchor;

an adapter positioned within the faucet support; and a mounting tube positioned within the faucet support and operably coupled to the adapter, the mounting tube comprising at least one finger arranged about an opening having a diameter, the at least one finger releasably engaging the lip of the anchor if the diameter is reduced, wherein rotation of the adapter draws the mounting tube within the mounting body, moving the one or more fingers inward and reducing the diameter such that the at least one finger releasably engages the lip of the anchor thereby coupling the faucet support to the anchor.

2. The faucet assembly of claim 1, wherein the fingers comprise a flat surface.

3. The faucet assembly of claim 1, wherein the anchor further comprises one or more cleats disposed in one or more grooves, the one or more cleats operable to travel along the one or more grooves, the anchor operable to mount to a mounting deck.

4. The faucet assembly of claim 1, wherein the anchor has an opening of a second diameter, the second diameter larger than the diameter of the mounting tube.

5. The faucet assembly of claim 1, further comprising a mixing valve within the mounting body.

6. The faucet assembly of claim 5, wherein the mixing valve receives liquid from at least two different sources, and alters the flow of each of the at least two different sources in an outlet stream.

7. The faucet assembly of claim 1, wherein the adapter includes projections to interact with one or more tools to rotate the adapter.

8. The faucet assembly of claim 1, further comprising a sleeve to position one or more inlets or outlets within the anchor.

9. The faucet assembly of claim 8, wherein the tube contains one or more wings to guide one or more of the one or more inlets or outlets.

10. A faucet assembly comprising:

a first anchor, including a body extending between opposing upper and lower ends, the first anchor including external threads disposed on the upper end of the body;

a housing receiving a mixing valve, the housing including internal threads to engage with the external threads of the first anchor;

a second anchor including a body having at least one recess; and a spout assembly comprising a substantially hollow spout with opposing first and second openings, a connector tube releasably attached to the spout at the first opening of the spout, the connector tube including a groove, and a bearing releasably attached to the connector tube, the bearing including first fingers to engage with the groove of the connector tube and second fingers to engage with the one or more voids in the second anchor, wherein rotation of the spout rotates the mounting tube relative to the first fingers of the bearing, and the bearing remains fixed relative to the second anchor.

11. The faucet assembly of claim 10, wherein the first anchor and the second anchor further comprises one or more cleats disposed in one or more grooves, the one or more cleats operable to travel along the one or more grooves, the anchor operable to mount to a mounting deck.

12. The faucet assembly of claim 10, further comprising a mixing valve within the housing.

13. The faucet assembly of claim 12, wherein the mixing valve receives liquid from at least two different sources, and alters the flow of each of the at least two different sources in an outlet conduit.

14. The faucet assembly of claim 10, further comprising a keying ring within the housing, the keying ring orienting the housing to one position with regard to the first anchor.

15. The faucet assembly of claim 10, wherein the first anchor further comprises a gasket disposed between the surface of a mounting deck and the first anchor.

16. The faucet assembly of claim 10, wherein the second anchor further comprises a gasket disposed between the surface of a mounting deck and the second anchor.

* * * * *